US006105399A

United States Patent [19]

Frullini et al.

[11] Patent Number: 6,105,399

[45] Date of Patent: Aug. 22, 2000

[54] METHOD AND APPARATUS FOR MANUFACTURING TUBULAR KNITTED ARTICLES

[75] Inventors: Alberto Frullini; Paolo Frullini, both of Florence, Italy

[73] Assignees: Fabritex S.r.l.; Sangiacomo S.p.A., both of Italy; a part interest

[21] Appl. No.: 09/204,187

[22] Filed: Dec. 3, 1998

[30] Foreign Application Priority Data

Dec. 4, 1997 [IT] Italy ..... FI97A0265

[51] Int. Cl.[7] ..... D04B 9/56

[52] U.S. Cl. ..... 66/148; 66/147

[58] Field of Search ..... 66/147, 148, 8, 66/19, 31, 58, 13, 21, 48, 47, 16

[56] References Cited

FOREIGN PATENT DOCUMENTS 0 592 376 B1 7/1997 European Pat. Off. .
0 635 593 B1 10/1997 European Pat. Off. .
1 346 518 11/1963 France .
1 635 992 7/1971 Germany .
WO 97/20089 6/1997 WIPO .

*Primary Examiner*—Danny Worrell
*Attorney, Agent, or Firm*—McGlew and Tuttle, P.C.

[57] ABSTRACT

A method for manufacturing a tubular knitted article with a toe end closed by a machine provided with a cylinder (1). The machine has a first and second series of needles disposed opposite to each other on corresponding semicylindrical portions of the same cylinder (1) and has a plate (3) provided with hooks (30). The process includes an initial step for the formation of the fabric of the toe in the form of a pocket (SC) by utilizing the needles (2) of the first series and corresponding hooks of plate (3). Steps for the removal and transfer of the fabric portion engaged by the hooks of the plate (3) by a 180° rotation about a diametral axis of said cylinder (1) to dispose this fabric portion in correspondence of the needles (20) of said second series. Between the step for the removal of the fabric portion engaged by the hooks of the plate (3) and the transfer step, provision is made for the transfer of the fabric portion engaged by the hooks of the plate (3) onto structure for the formation of the pocket (ST), and/or associated to the formation device and connected to the cylinder of the needles.

20 Claims, 35 Drawing Sheets

METHOD AND APPARATUS FOR MANUFACTURING TUBULAR KNITTED ARTICLES

FIELD OF THE INVENTION

The present invention refers to a method and apparatus for manufacturing tubular knitted articles, such as stockings and the like, with a closed end.

BACKGROUND OF THE INVENTION

Patents EP 592376 and EP 635593 disclose a method and a machine for manufacturing tubular articles such as stockings, starting from the elastic edge or hem and finishing on the toe side. In the first of the above cited patents, provision is made for closing the toe in correspondence of the cylinder of needles performing the knitting of the article. The second of these patents discloses a method and a machine for closing the article toe outside the needles cylinder, that is, at a station separated from that for knitting. However, in both cases, although the resulting is article results of a very high quality with respect to the standards usually accepted in the sector, the structural and operational complexity of the machine increases the relevant manufacturing cost.

Document WO 97/20089 refers to a method and apparatus for closing the toe of a tubular knitted article, on the same machine on which the article is made, wherein the initial step for knitting the article portion intended to form the toe is accomplished by using the needles of half the knitting cylinder, the needles cooperating with the hooks of the plate, so as to engage this part of the fabric to the structure of the plate, as normally provided for the execution of the so-called "double edge" and as disclosed in the documents FR 1.346.518 and DE 1.635.992. The stitches associated to the hooks of the plate are then withdrawn by an assembly of members with hooks and relevant closing pegs carried by a semicrown pivoted to a diametral axis of the needles cylinder to allow said stitches to be taken out and subsequently moved by an overturning of said crown through 180° about said axis following the removal of the plate from the needles working area, in order to dispose these stitches onto the needles of the other half of the cylinder and then to continue the knitting until the formation of the elastic edge or hem. However, although this document does not describe in detail the structure of the machine and, in particular, the means which should provide for the control and execution of said overturning, as well as for resuming the initial condition of said semicrown, it can be inferred therefrom that the latter is engaged to the cylinder. Accordingly, the rotation of the cylinder upon the knitting of any portion of the article would imply the corresponding driving into rotation of the semicrown and of all the members housed therein. This, obviously, brings about a structural complexity of the machine and a higher energy consumption since the driving of the semicrown is operated simultaneously to all the working steps during which the members for transferring the stitches from one side to the other of the cylinder are inoperative. In any case, the constant presence of the semicrown onboard of the machine implies signficant changes in the relevant structural parts thereof, expecially as far as the sinkers housing, sinkers crown and sinkers themselves are concerned, and this, besides heavily limiting the possibility of modifying the existing machines—whose construction could by no means allow these modifications—also causes a corresponding increase of the manufacturing cost.

SUMMARY AND OBJECTS OF THE INVENTION

The main object of the present invention is to overcome the drawbacks noted above.

This result has been achieved, according to the invention, by providing a process and apparatus having the characteristics indicated in the claims.

The advantages deriving from the present invention lie essentially in that it is possible to manufacture textile articles, such as stockings and the like, starting from the toe and finishing on side of the elastic hem, with a machine and an operational methodology definitely simpler, from both the functional and constructional point of views, more reliable, relatively less costly and with reduced energy consumption, inasmuch as during the manufacturing of the article, the moving members are only those actually needed for operation; that it is possible to update the circular machines already installed in the production plants without making excessive and costly modifications.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DESCRIPTION OF THE PREFERRED EMBODIMENTS

Figure 2:
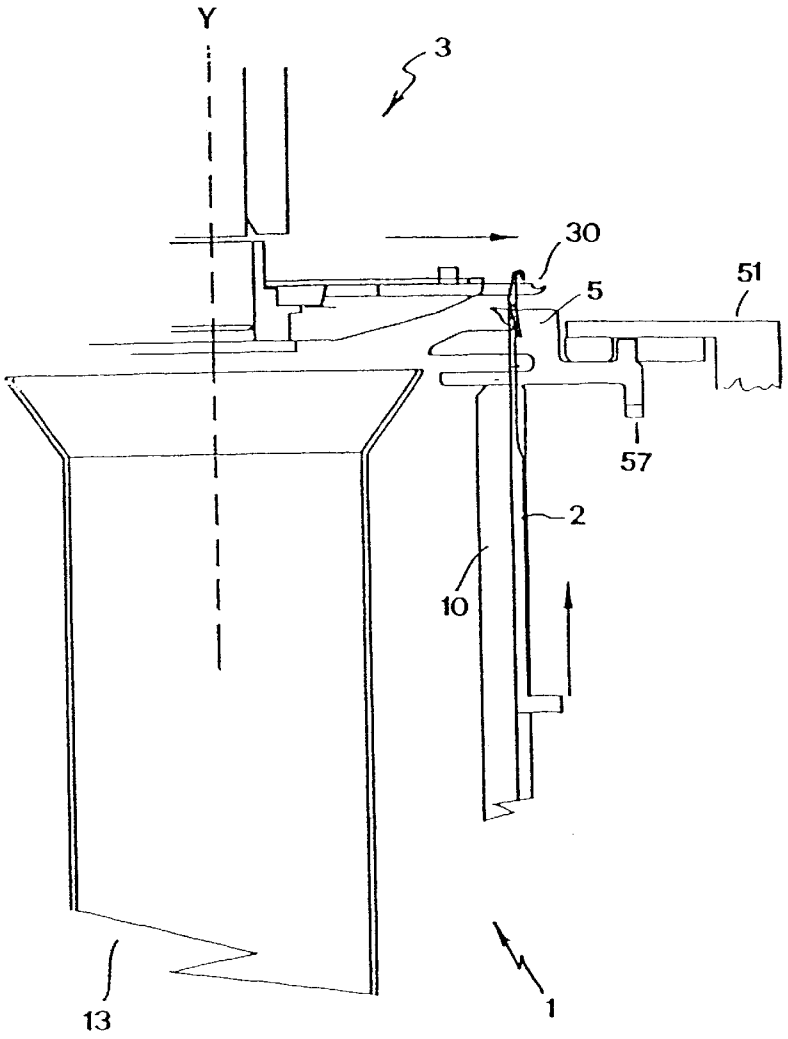
FIGS. 1 to 15 shows schematically the operating steps of the method according to the invention, in a sequence corresponding to a feasible embodiment thereof.
Figure 1:
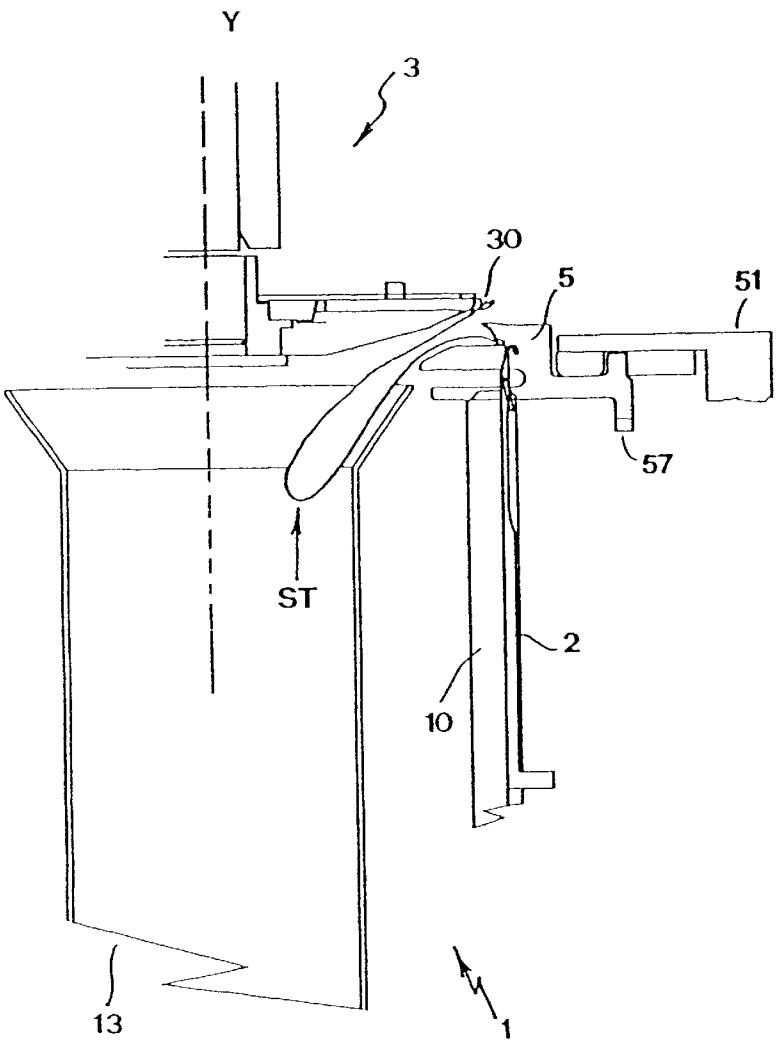
Figure 4:
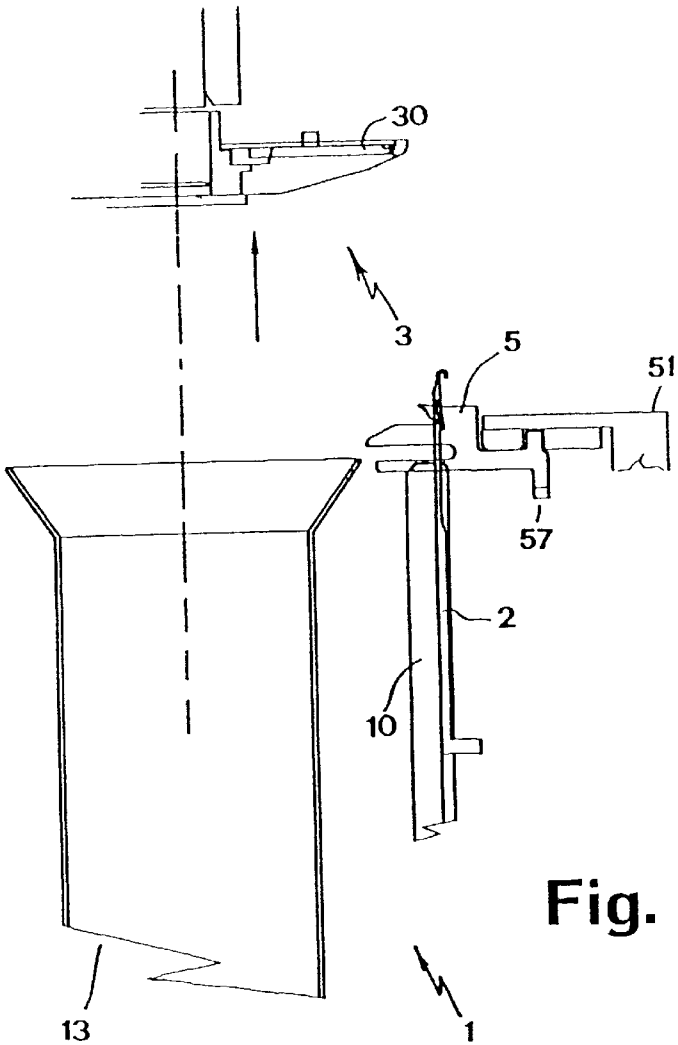
Figure 3:
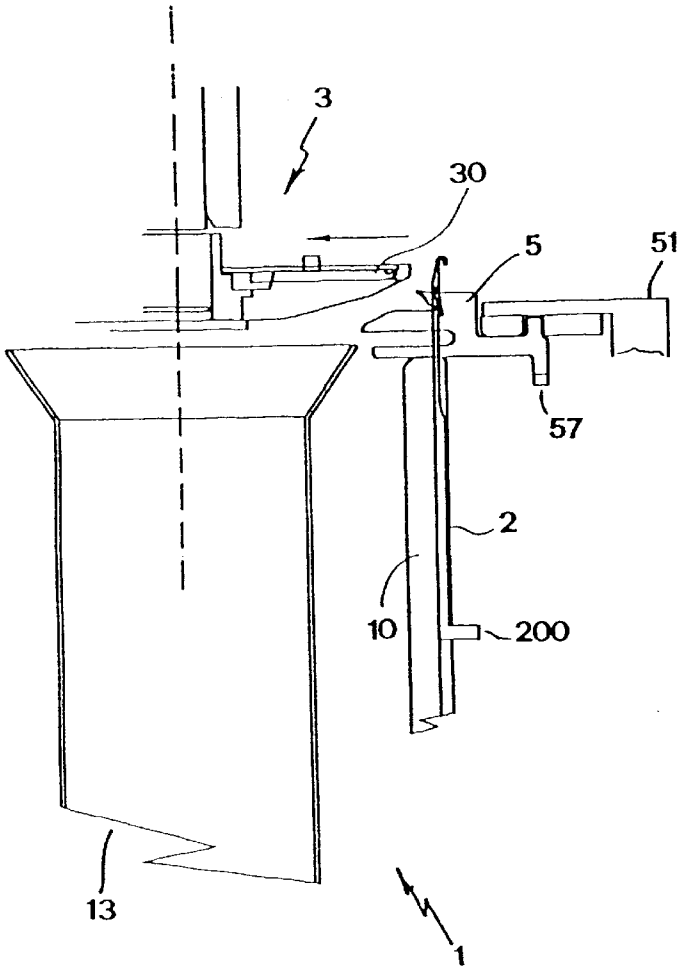

In the description that follows, the term "fabric", as removed from the hooks (3) of plate (30) and taken up by the members (4), will refer to the proper stitches and/or to the interweaving thread that links two adjacent stitches or loops.

Figure 6:
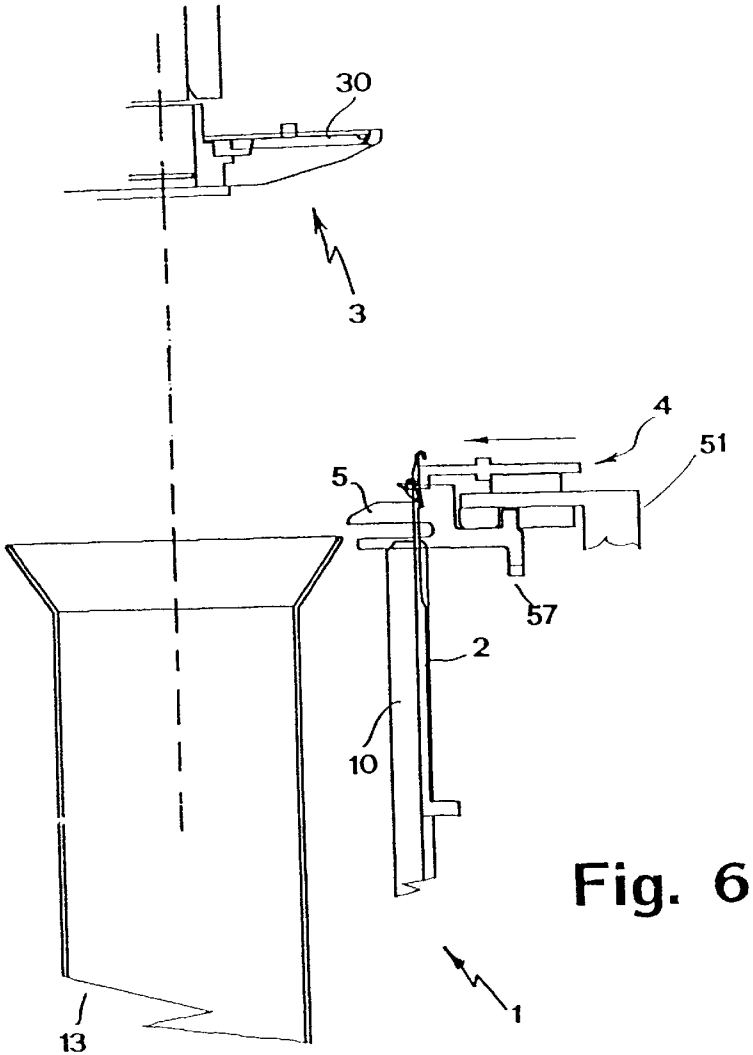
Figure 5:
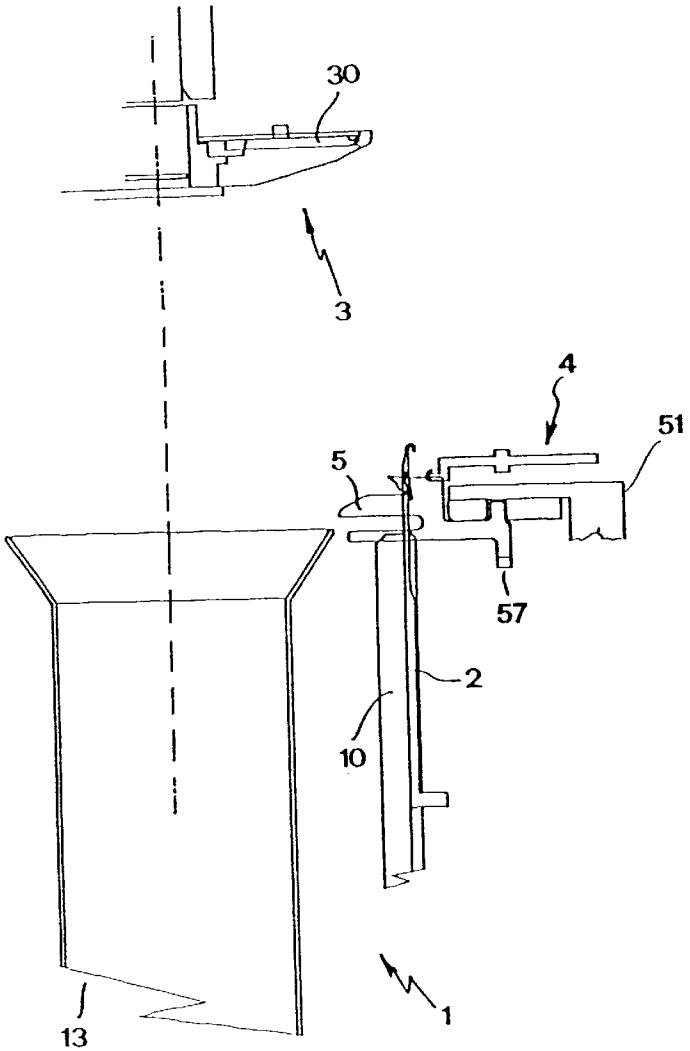
Figure 8:
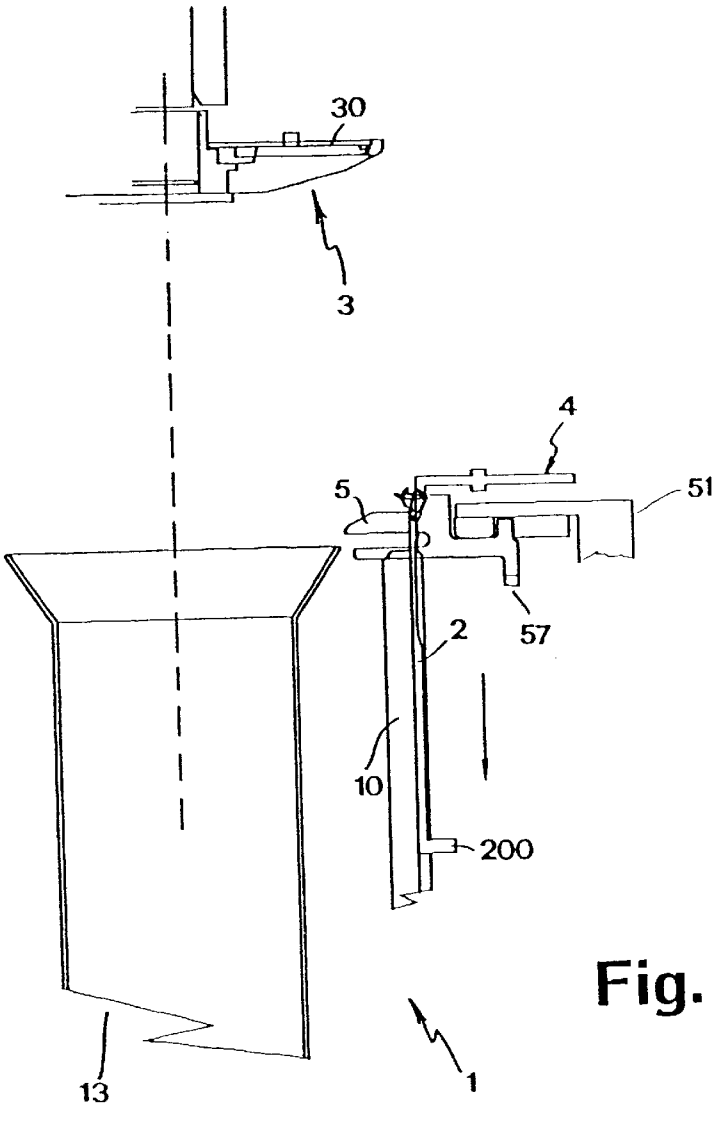
Figure 7:
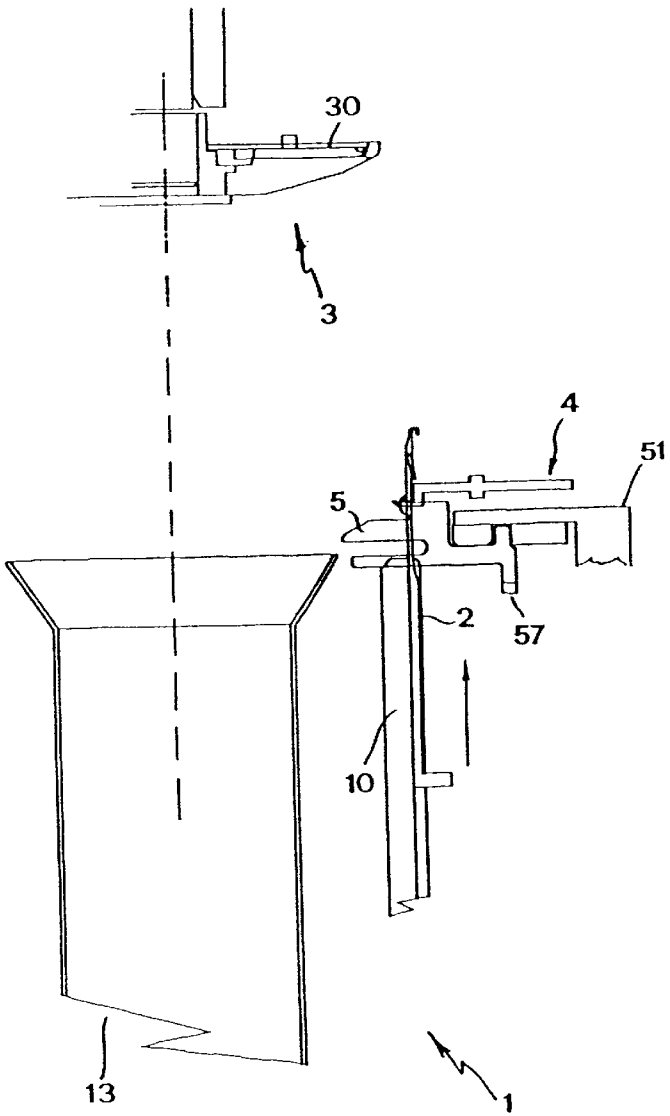
Figure 9:
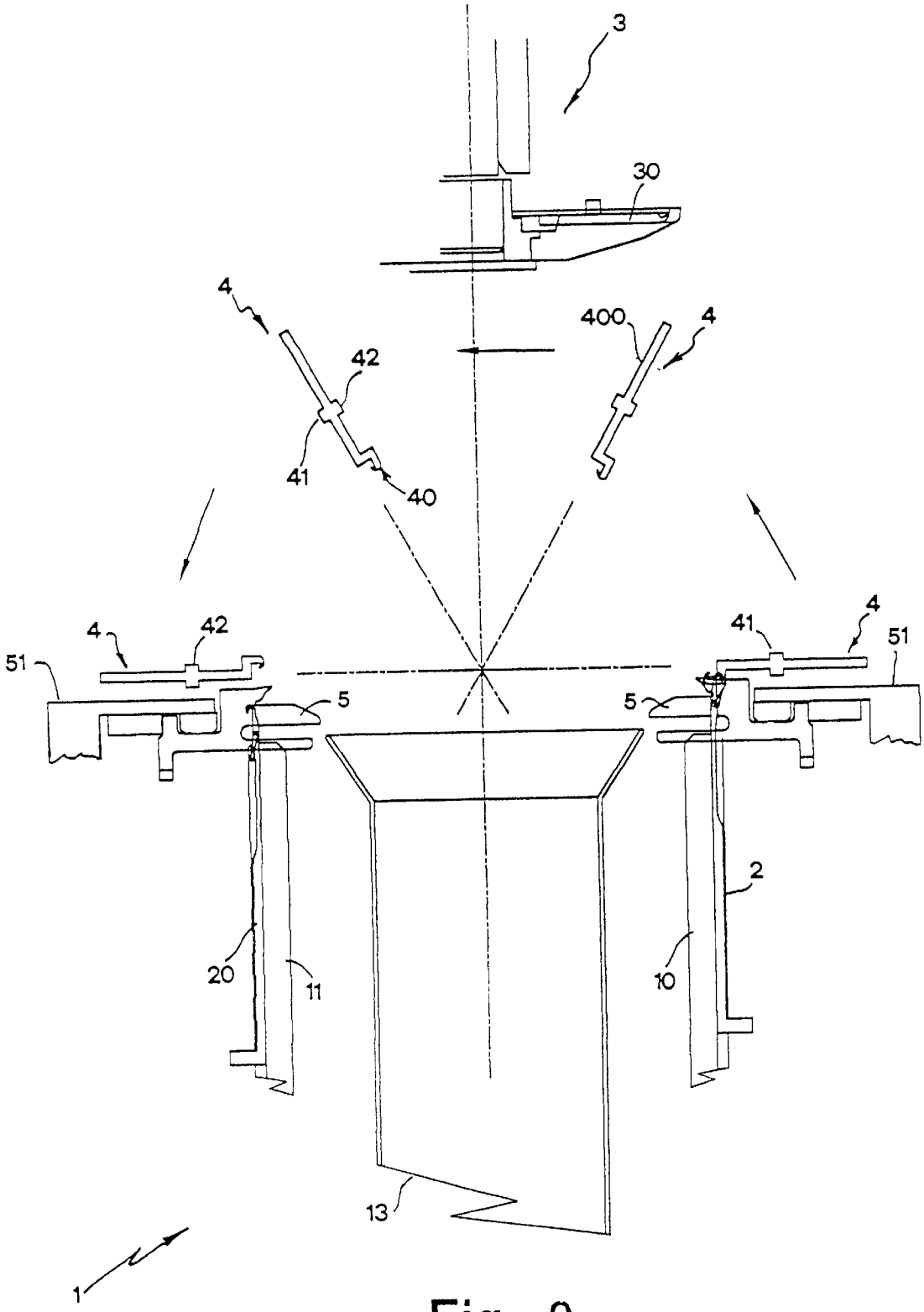
Figure 10:
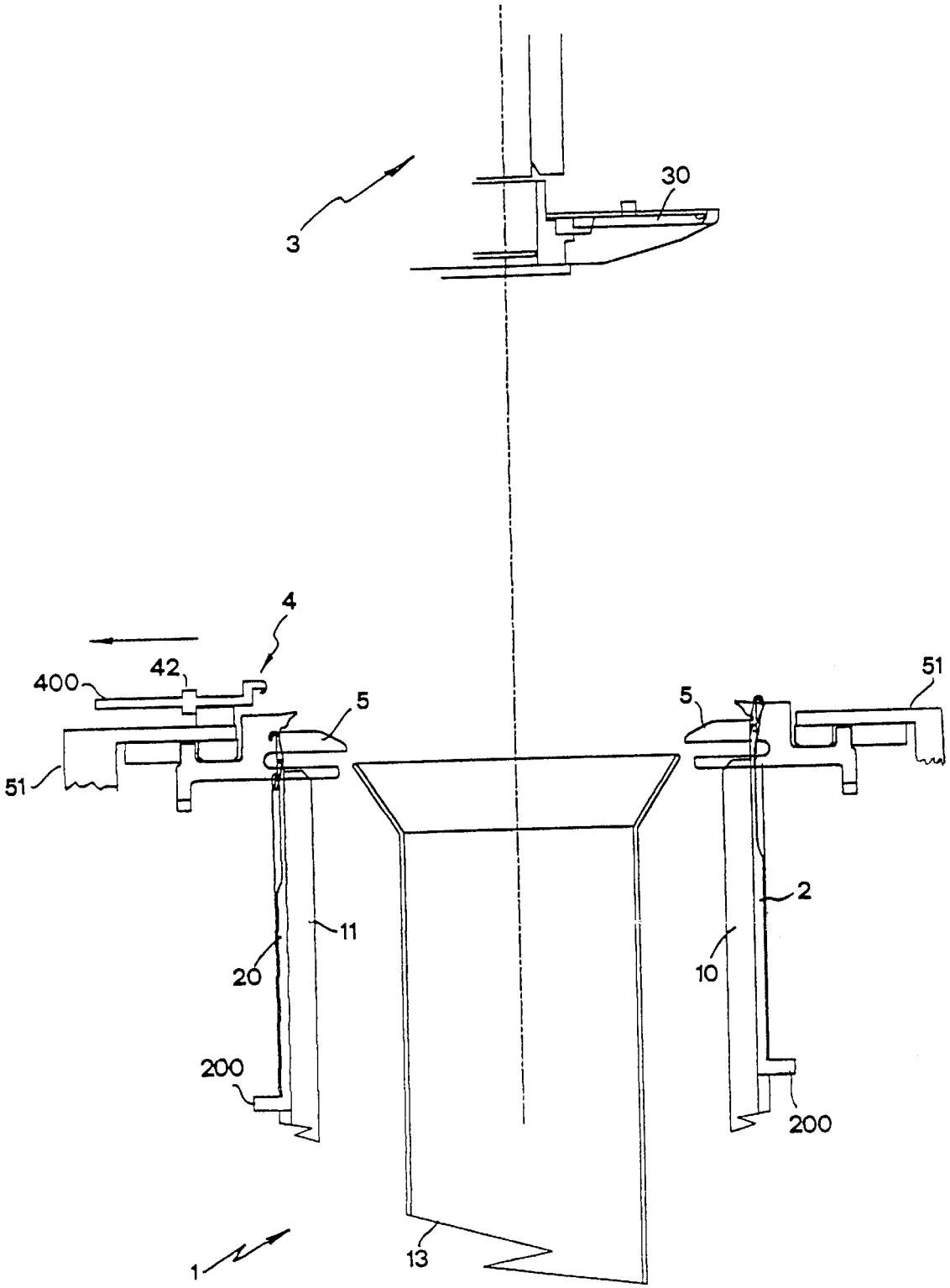
Figure 11:
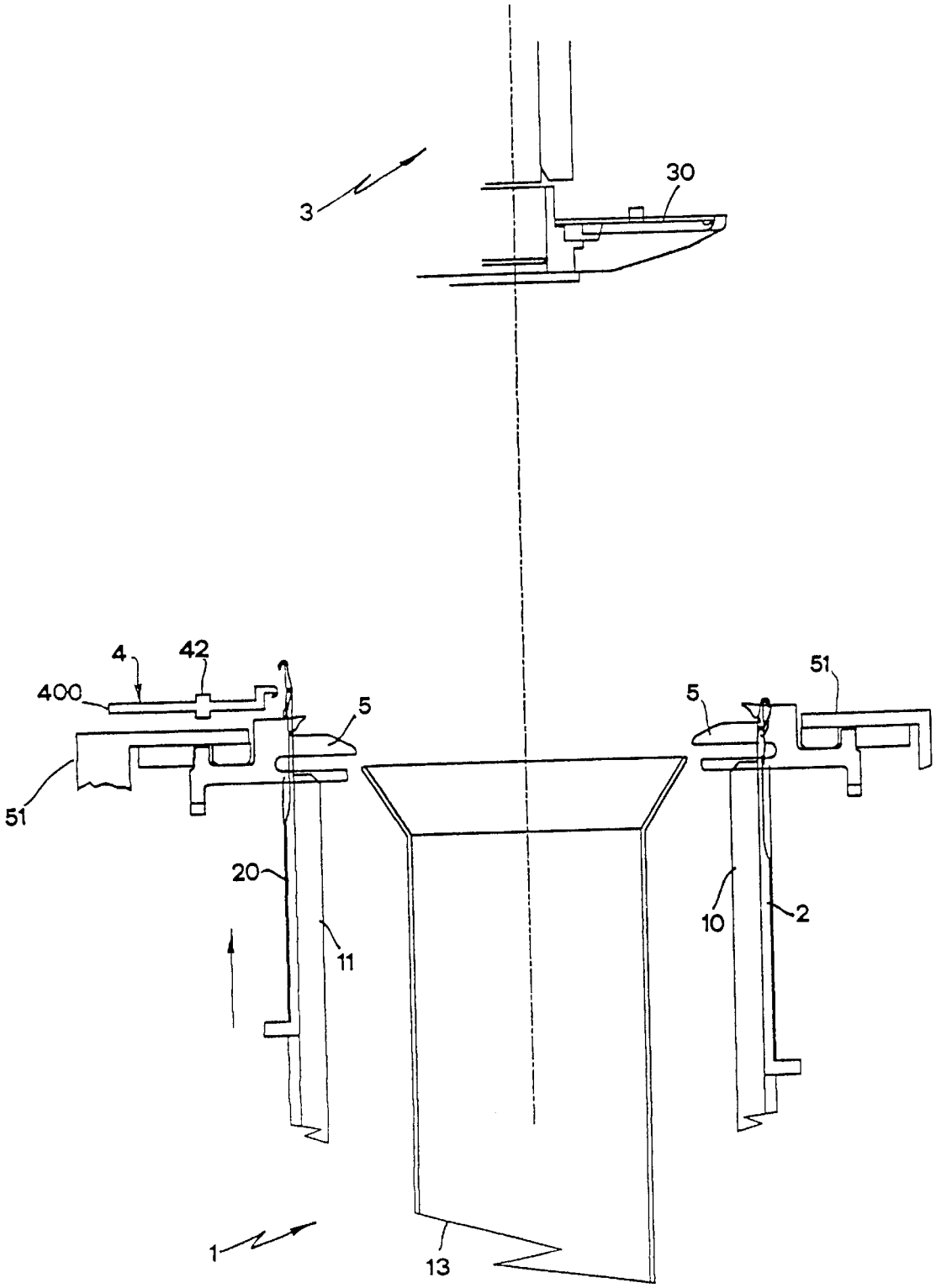
Figure 12:
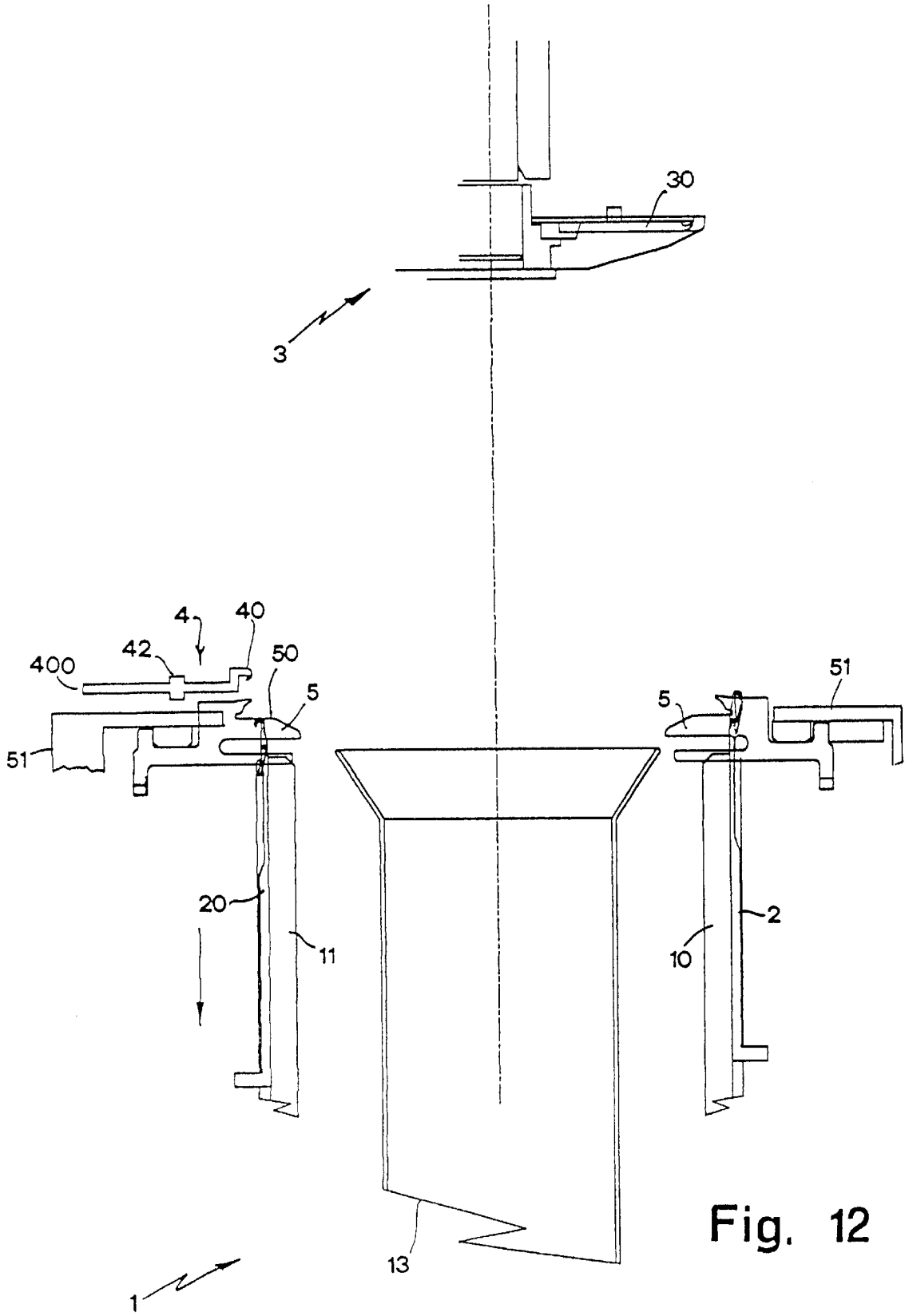
Figure 13:
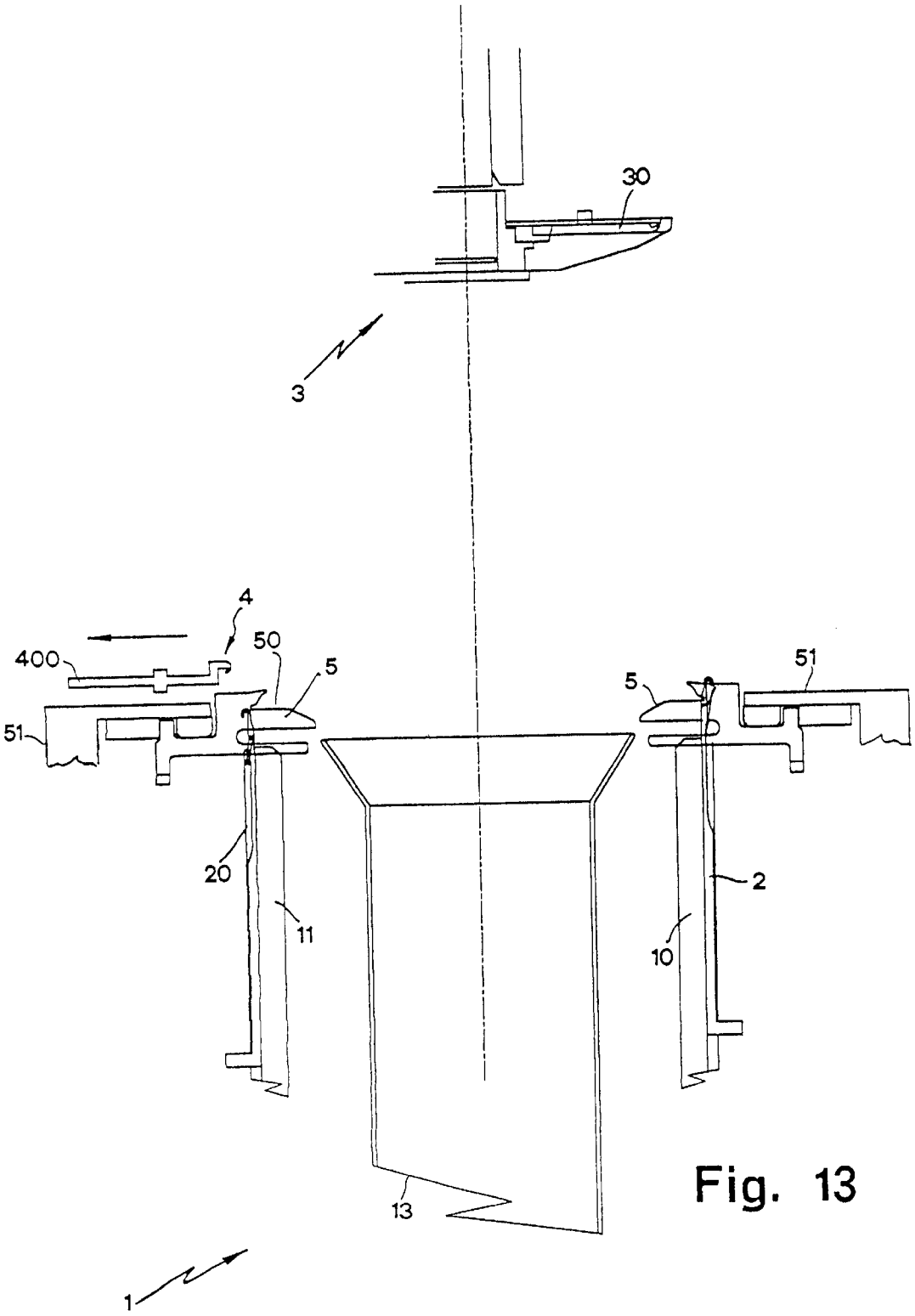
Figure 14:
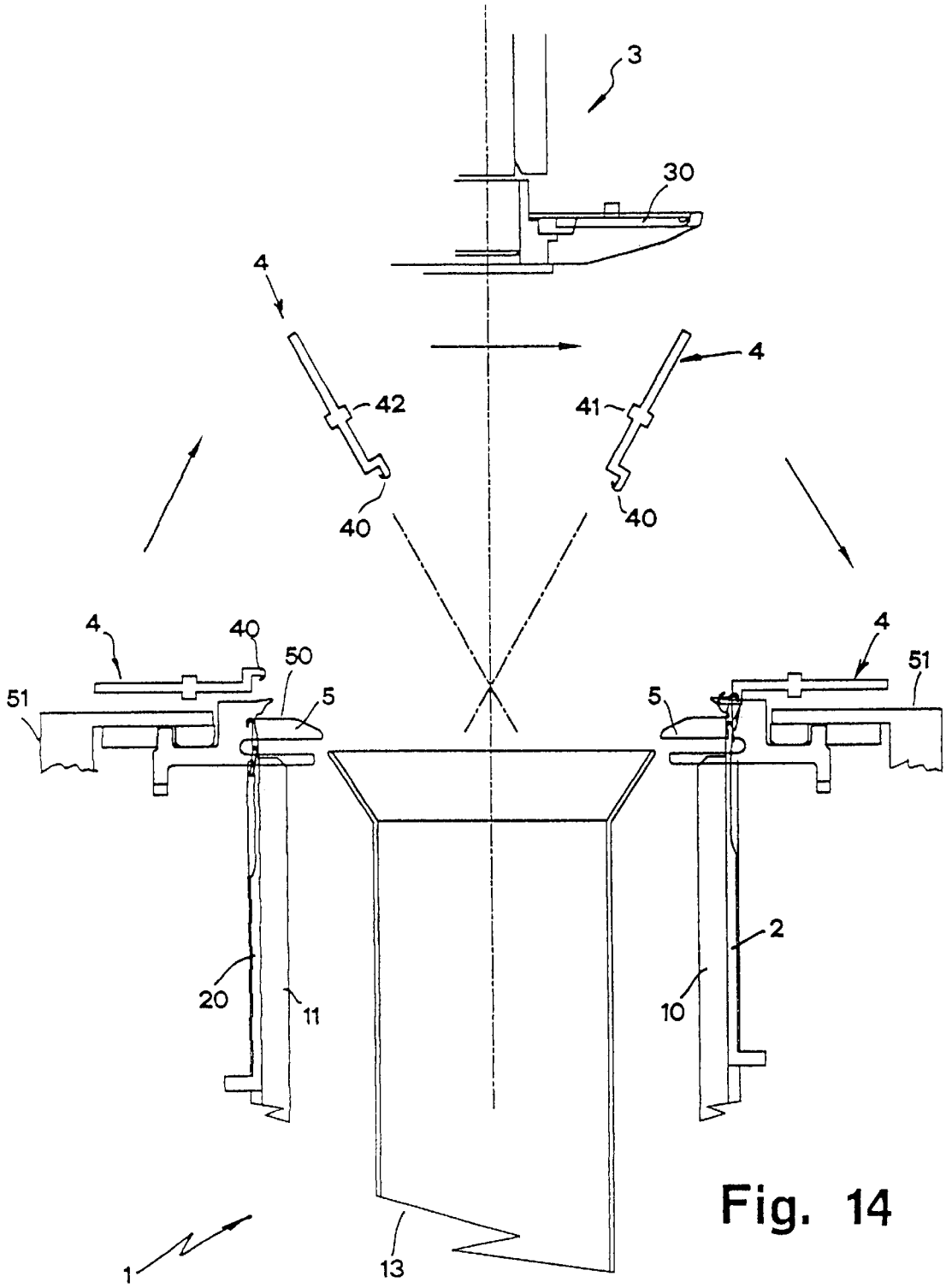
Figure 15:
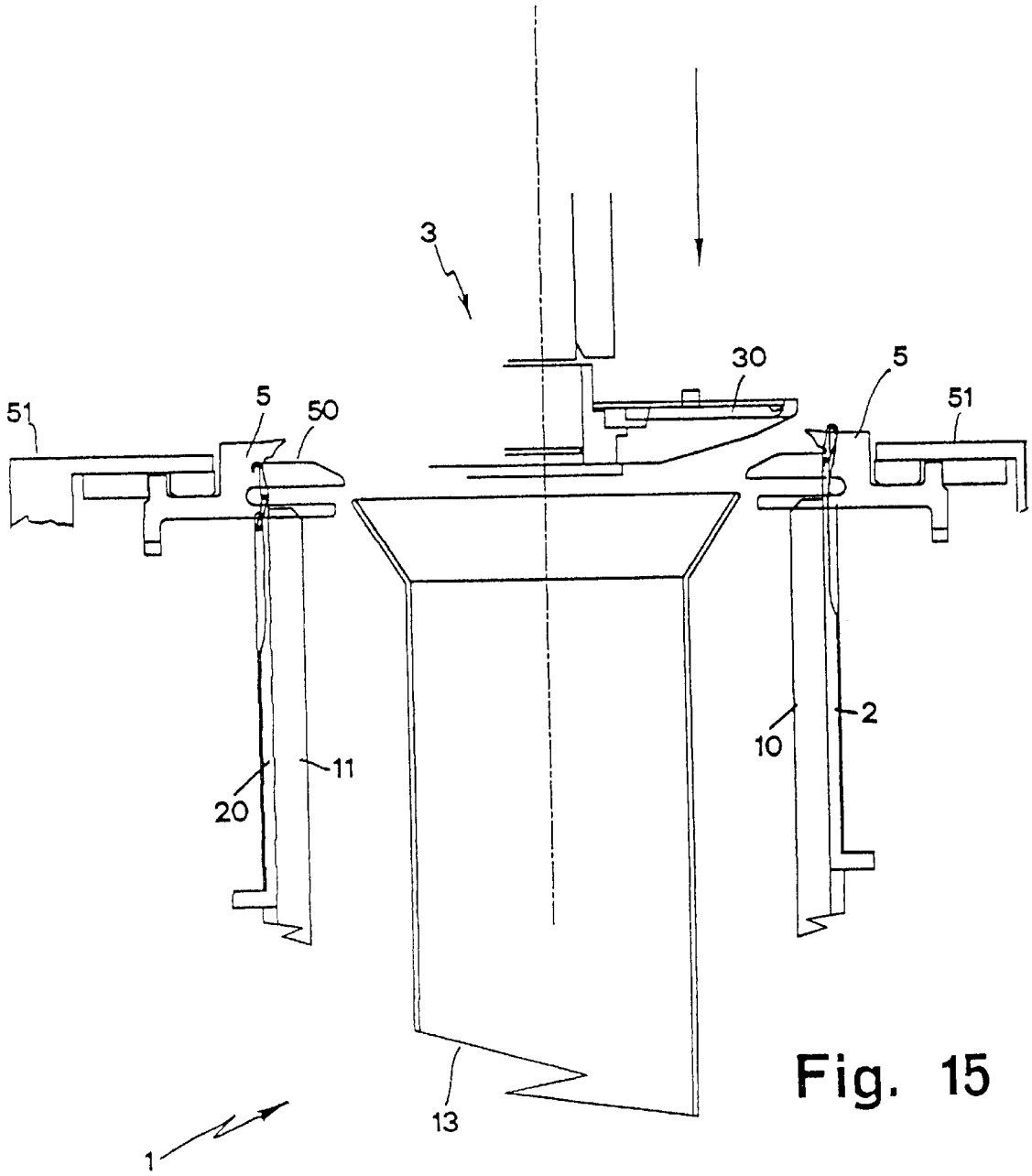
Figure 16:
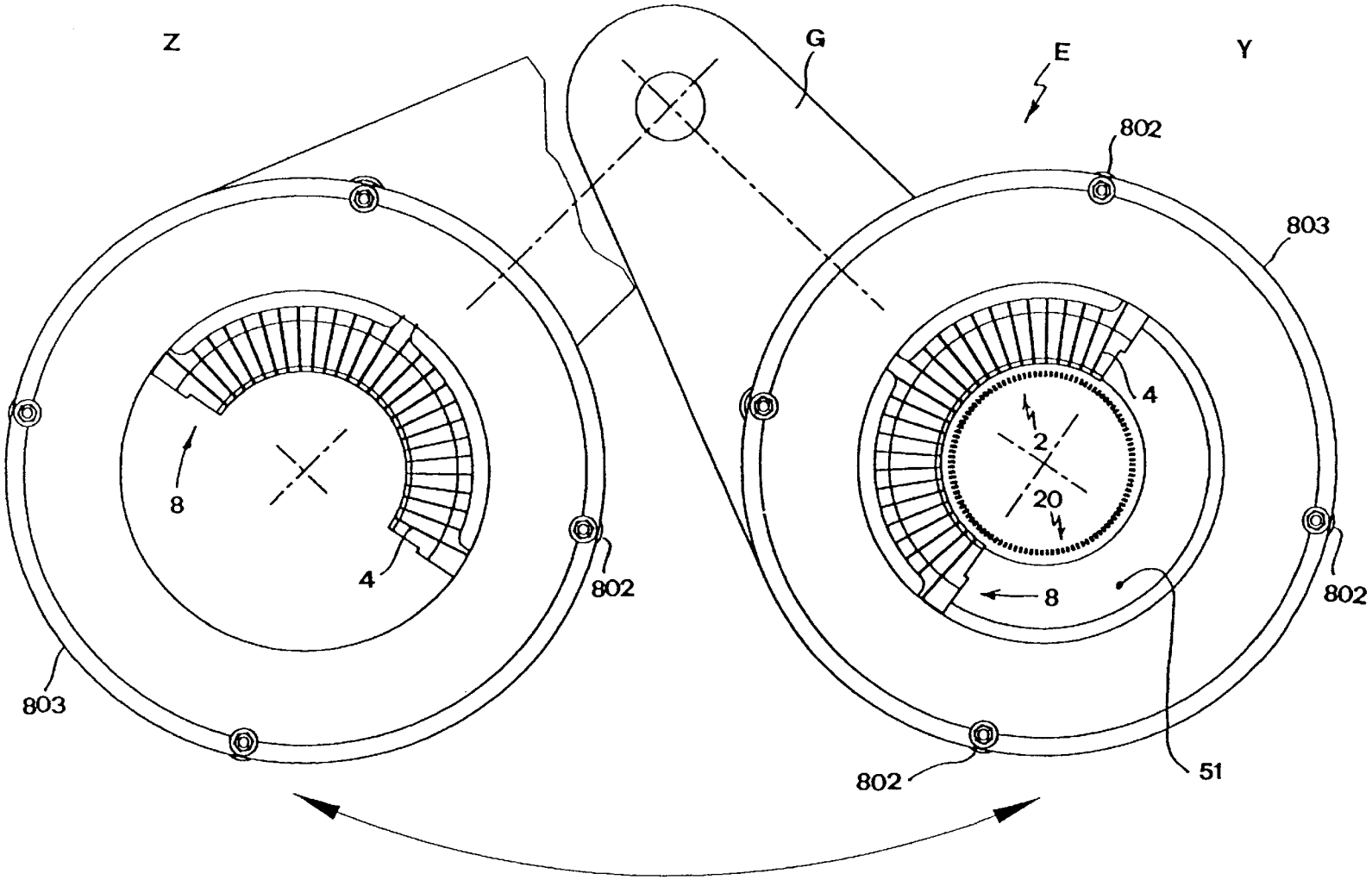
FIG. 16 shows the detail, in plan view, of the movable unit (E) which supports the semicrown (8) receiving the members intended to remove and transfer the stitches from the needles (2) of the first series to those (2) of the second series, according to a feasible embodiment: in Y said movable unit being in operative condition, in correspondence of the textile head of the machine, whereas in Z, the same unit being in inoperative condition outside the working area of the needles.

Reduced to its basic structure, and reference being made to FIGS. 1 to 15 of the attached drawings, an operational method according to the invention comprises the following steps:

operating the knitting of the article by means of a circular machine comprising a cylinder (1) with a plurality of needles (2, 20) so disposed as to define a first and a second series of needles acting, respectively, on corresponding substantially semicylindrical portions (10, 11) of the cylinder: means being provided for the vertical reciprocating motion of the needles (2, 20) according to the predetermined knitting program; the knitting is started by using the needles (2) of said first series, and the formation of the first ranks of stitches—the number of the interested ranks possibly varying in relation to the textile structure to be given to the article—is operated by the withdrawal of the hooks (30) housed in the plate (3) of the machine, so that the hooks pick up the thread together with said needles (2). This operation allows the engagement to the hooks (2) and, therefore, to the plate (3) supporting them, of the corresponding toe portion of the article;

withdrawing the said hooks (30), after the thread engagement, in order to continue the knitting of the toe of the article; such knitting being possibly operated in different ways depending on the mechanical and textile characteristics of the machine. In any case, a fabric pocket (ST) is produced, developed over three spatial dimensions and having a substantially conical shape with circular base. This base results with one part of the stitches of the last rank being disposed on the needles (2) of the first series and with the remaining portion of the stitches being suspended to the corresponding hooks (30) of plate (3)—the stitches suspended to the hooks (30) standing above those of needles (2). Upon completion of this step, the above mentioned fabric pocket (ST) is situated folded over itself (FIG. 1), the needles (2) of the first series are all in lowered position and any thread used for the knitting is cut. For the sake of clarity, the said fabric pocket (ST) is schematically shown only in FIG. 1 of the drawings;

operating the advancement of said hooks (30), so as to move the corresponding portion of fabric towards the needles (2) of the first series which are caused to lift up (FIG. 2) for a travel of preset length in order to transfer the fabric of the hooks (30) onto the same needles (2);

withdrawing the hooks (30) associated to the plate (FIG. 3) so that all the fabric will result engaged only to the needles (2) having formed it, and lifting up the plate unit (3) to move it away from the textile head of the machine (FIG. 4); also moved away from the textile head of the machine are all those members, hereinafter referred to in whole as "plate group", such as the thread-guide units and the thread-feeding mouths, which could possibly impair the correct execution of the subsequent operating steps;

positioning, in correspondence of said needles (2) of the first series, such removal means (4) able to pick up the fabric removed from the corooks (3) (FIG. 5): said removal means (4) being outside the working area of the needles (2) during the knitting of the pocket (ST)—for example, disposed in a position external to the textile head of the machine—and being disposed in operative condition in the working area of the needles (2) only after the removal of the fabric from the hooks (30) of the plate group (3) and after the moving away of the latter;

hooking up the fabric removed from the plate's hooks (30) by means of said removal means (4) (FIG. 6). To operate this removal, provision may be made to further lift the needles (2) so as to dispose the relevant stitches below the respective tongues, that is, in a position suitable for unloading them from the needles (2) during a subsequent step (FIG. 7);

transferring onto said removal means (4) the fabric thus hooked up. To this end, provision being made for lowering the needles (2), as shown in FIG. 8, so as to determine the unloading of the stitches, that is, the passing of each of them over the tongue (21) of the corresponding needle (2), which tongues closes up automatically upon the lowering of same needle;

transferring the portion of the pocket (ST) thus picked up, with a rotation thereof of 180°, above the needles cylinder (FIG. 9), about a diametral axis of the latter, in order to dispose it above the needles (20) of the second series, that is, of the needles opposite to those (2) which have operated the knitting of the pocket (ST). To this end, it may prove necessary moving the removal members (4) as schematically indicated by the arrow in FIG. 10;

transferring the fabric portion thus moved onto the needles (20) of the second series, bringing the plate group (3) back to the work position (FIG. 15), continuing the knitting of the article and finishing with the formation of its open end or hem. Before bringing the plate (3) back to the work position, provision is suitably made for moving away the removal means (4) by disposing this in the starting condition and in a position outside the cylinder (1). The subsequent knitting of the article, up to its completion, takes place according to procedures known per se to those skilled in the art and, therefore, not be described herebelow in greater detail. To operate the transfer of the stitches from the hooks (3) to the needles (20) of the second series, provision is made for lifting these needles (20), after the complete overturning of removal members (4), up to a level allowing the above-standing fabric to go therethrough, but without the same fabric getting below the respective tongues (21) (FIG. 11). In this way, the fabric of this portion of the article is retained on the needles (20) of the second series. Afterwards, as schematically shown in FIG. 12, provision is made for lowering the needles (20) of the second series, with the machine's sinkers (5) being retracted, that is, open in a way allowing the relevant stitches to be disengaged from the hold of members (4) and be driven downwards until they reach the stitch plane (50) of sinkers (5). Thereafter, the members (4) are brought back to the starting position (FIGS. 13 and 14) by a movement opposite to the one previously determining the transfer of the stitches from the needles (2) of the first series to those (20) of the second and, finally, provision is made for moving back the said members (4) outside the area of the cylinder (1) in a condition suitable for a cyclical repetition of the operating steps above described, before lowering the plate (3) to keep on with the knitting.

As far as the apparatus for carrying out the above method is concerned, it comprises, according to an exemplifying embodiment:

a circular machine for manufacturing tubular knit articles, with a cylinder (1) provided with a first and second series of needles (2, 20) acting on corresponding semicylindrical opposite portions (10, 11), with a plate (3.) to which a plurality of hooks (30) are associated to move from and to said needles (2, 20), and with a series of sinkers (5) carried by a crown (510) and operated by cam members (511) of a housing (51) mounted externally to said portions (10, 11) of the cylinder (1). All these members, as well as the respective drive and control means are known per se to those skilled in the art and, therefore, will not be described herein in greater detail;

means for removing and driving the fabric of said pocket (ST) being transferred onto the needles (2) of the first series by the corresponding hooks of plate (3), with a plurality of flat members (4) carrying a hook (40) on one end for removing and driving the stitches and provided with facing heels (41, 42) emerging from the respective stem (400) which extends longitudinally from the opposite side of the hook (40) to allow the displacement thereof from and to the needles (2, 20) of cylinder (1) by means of the corresponding control cams (6, 7): said flat removal members (4) being received into corresponding radial or substantially radial slits (81) of a support (8) shaped like a circular semicrown and provided with diametrally opposing pivots (82) to allow the rotation thereof through 180° about the common axis (R—R) of said pivots when requested, as better described later on. The said cams (6, 7) are mounted on the sinkers housing (51) to be driven between a first operating position and a second inoperative position under control of corresponding linear bidirectional actuators acting on corresponding guide stems (60, 70);

two bodies (820) for supporting said semicrown (8), which are provided with seats for housing diametral free-to-rotate pivots (82) of the semicrows (8)

means for controlling the bidirectional rotation of said semicrown (8) about a diametral axis of cylinder (1), with angular displacement through 180° above the working area of the needles (2, 20);

means for supporting said members (4), with the semicrown (8), relevant support bodies (820) and two blocks (80) being disposed orthogonally to said axis (R—R) of rotation of the semicrown (8), comprising a unit (E) movable between a work position (Y) in correspondence of the work area of needles (2, 20) and a stand-by position (Z) outside the textile head of the machine, with a circular crown (800) solid to blocks (80) and supports (820) on which the semicrown (8) is made to rest, the latter being guided on the respective peripheral rim (801) by means of correspondingly profiled bearings (802) carried by a cantilever structure (803) connected via an arm (G) to a hollow column (804) parallel and external to the cylinder (1) and inside which a shaft (805) is provided connected via a joint (806) with means (TR) for transmitting the motion to the members of cylinder (1) normally provided at the bottom thereof: the structure (803) also carrying a train of gears (808, 809) able to transmit the relative motion of the said shaft (805) to the semicrown (8) through a corresponding toothing (807) provided on the rim of the circular crown (800);

means for moving said unit (E) between said stations (Y) and (Z), with a pneumatic actuator acting, either directly or with the agency of a gear-rack mechanism, on the column (804) which is suitably pivoted to a base.

Suitably provided are also means for tensioning the fabric during and after the overturning of the semicrown (8): To this end, there may be used, for example, the vertically movable suction tube (13) normally provided inside the cylinder (1). The use of said tube (13) also allows supporting the portion of the fabric under treatment at a height that prevents the respective stitches from hooking up members of the textile head.

Advantageously, according to the invention, as illustrated in FIG. 171 of the accompanying drawings, the stem (400) of said flat removal elements (4) may be suitably folded or curved to allow the sliding thereof on the walls of the respective guides (81) provided on the support semicrown (8) and, owing to the friction generated upon moving said guides, prevents same stem from being driven into an unwanted motion.

Figure 17A:
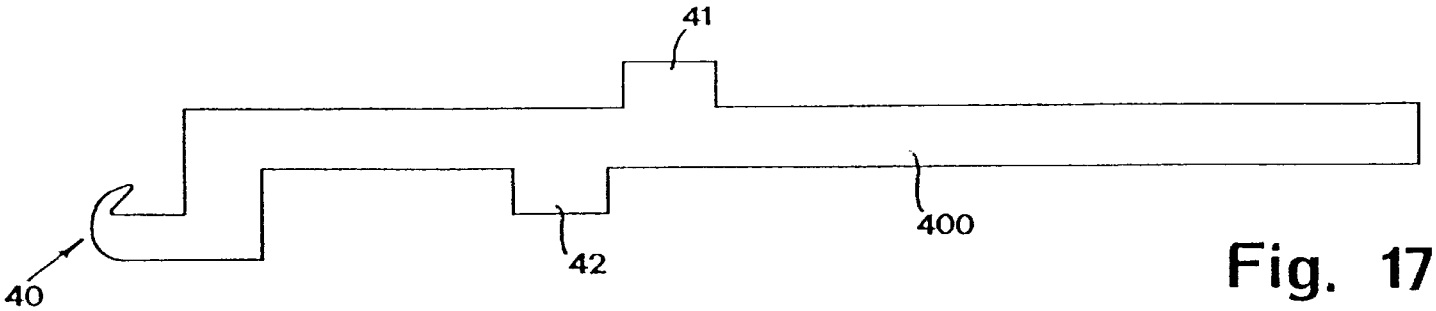
FIGS. 17A and 17B show the detail of a stitch-removing and transferring member, respectively in side and top view.
Figure 17B:
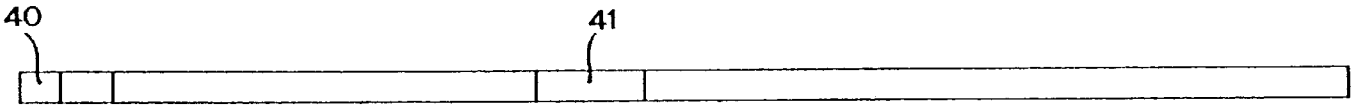
Figure 17C:
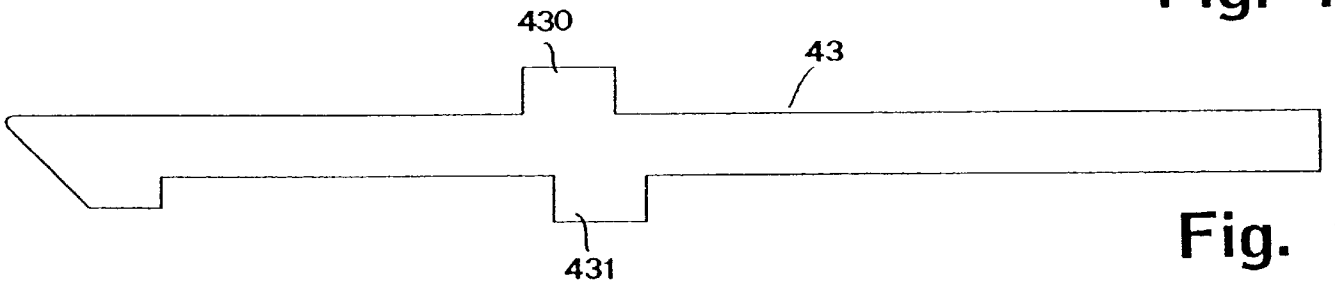
FIGS. 17C and 17D show the detail of a closing peg associated to the member of FIG. 17A, respectively in side and top view.
Figure 17D:
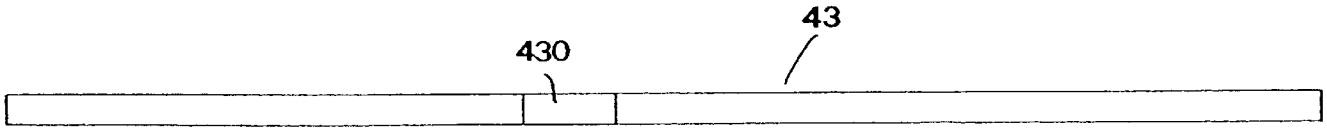
Figure 17E:
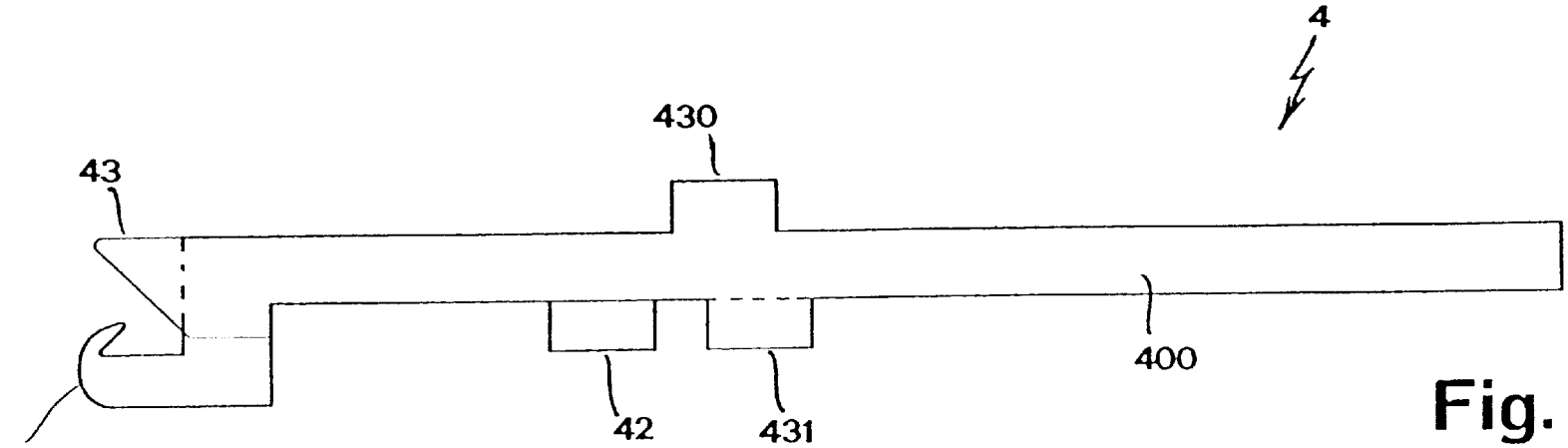
FIGS. 17E and 17F show, associated to each other, the members of FIGS. 17A–17D during the removal/release of the stitches, respectively in side and top view.
Figure 17F:
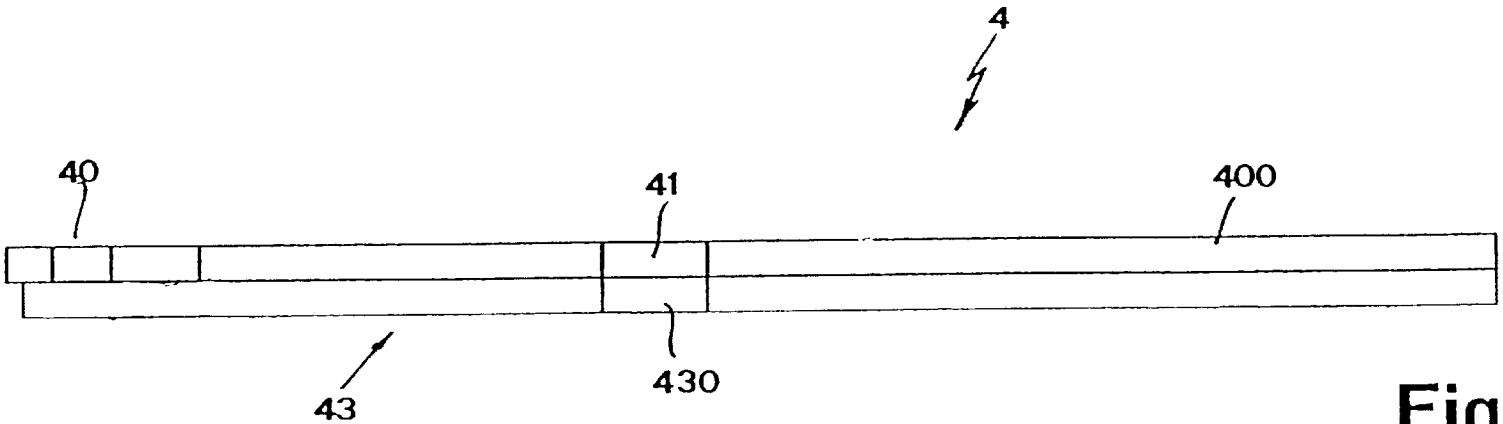
Figure 17G:
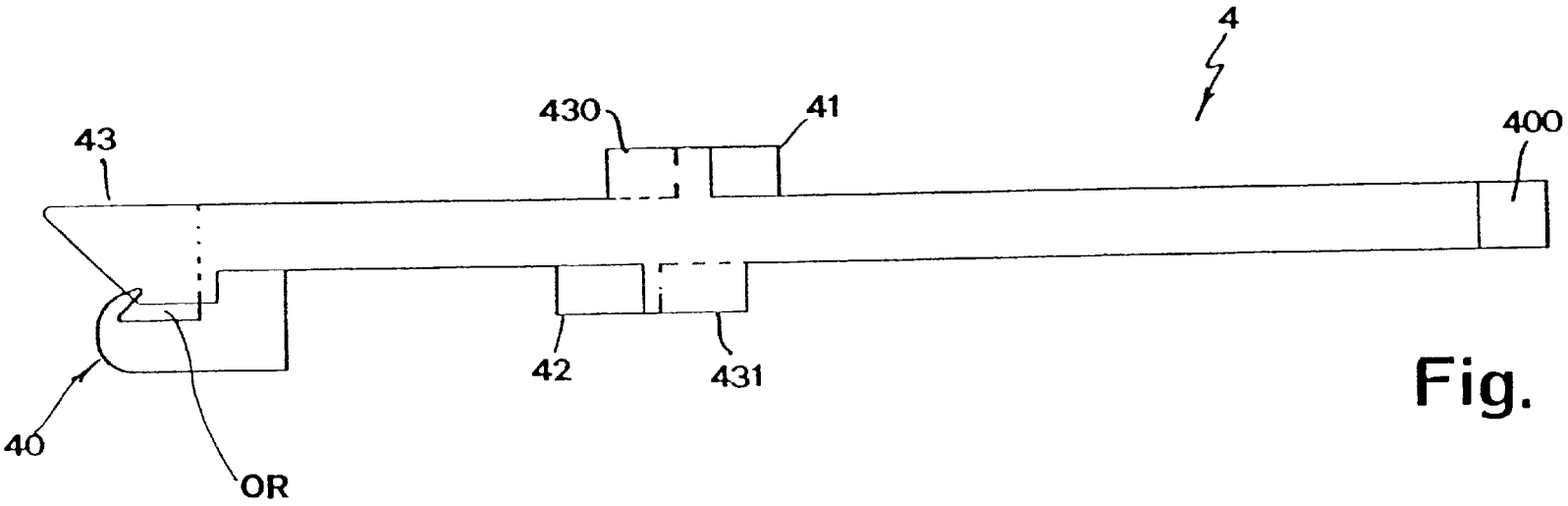
FIGS. 17G and 17H show the members of FIGS. 17E and 17F, in the same order of representation, in a stitches-gripping attitude.
Figure 17H:
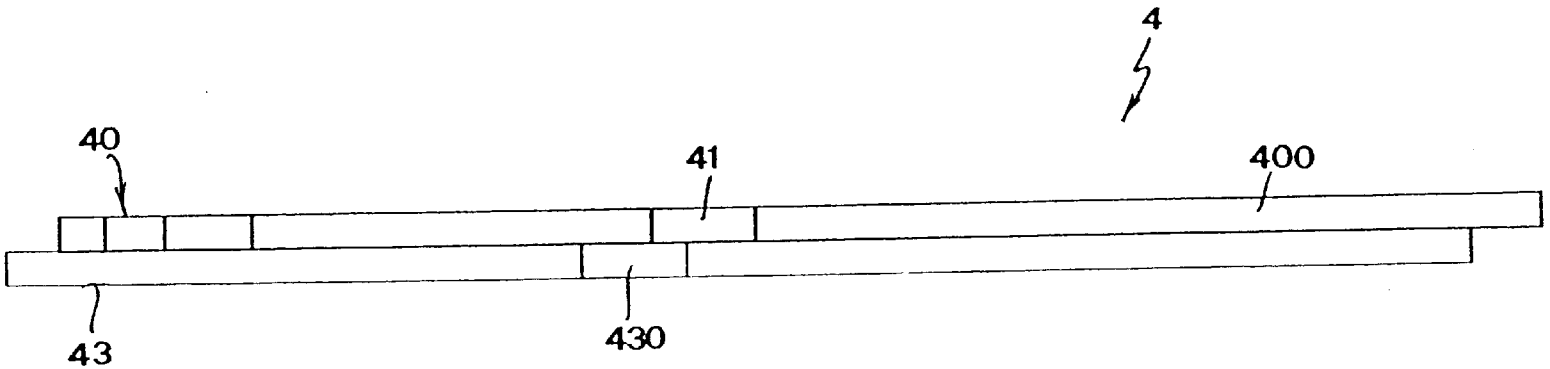
Figure 17I:
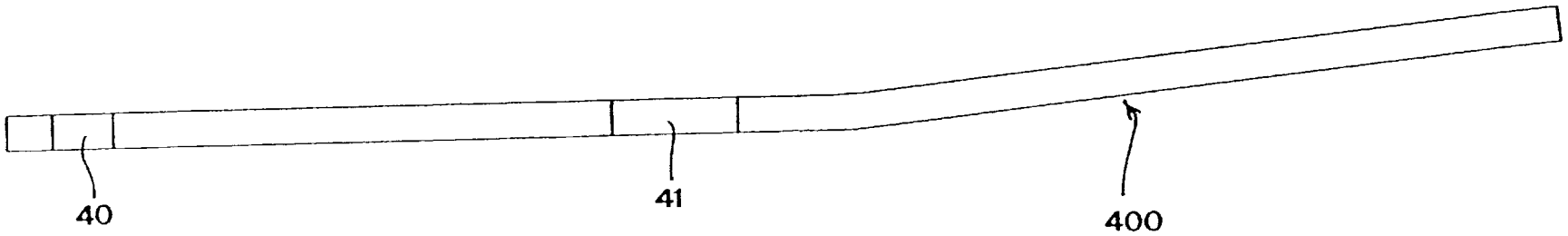
FIGS. 17I and 17L show two further embodiments of the removal member of the preceding figures.
Figure 17L:
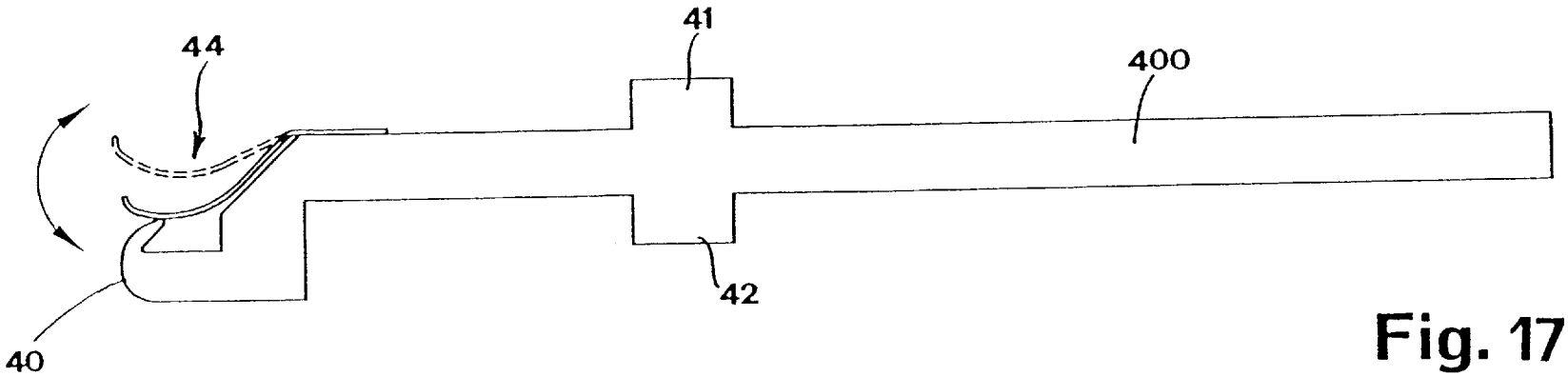
Figure 18:
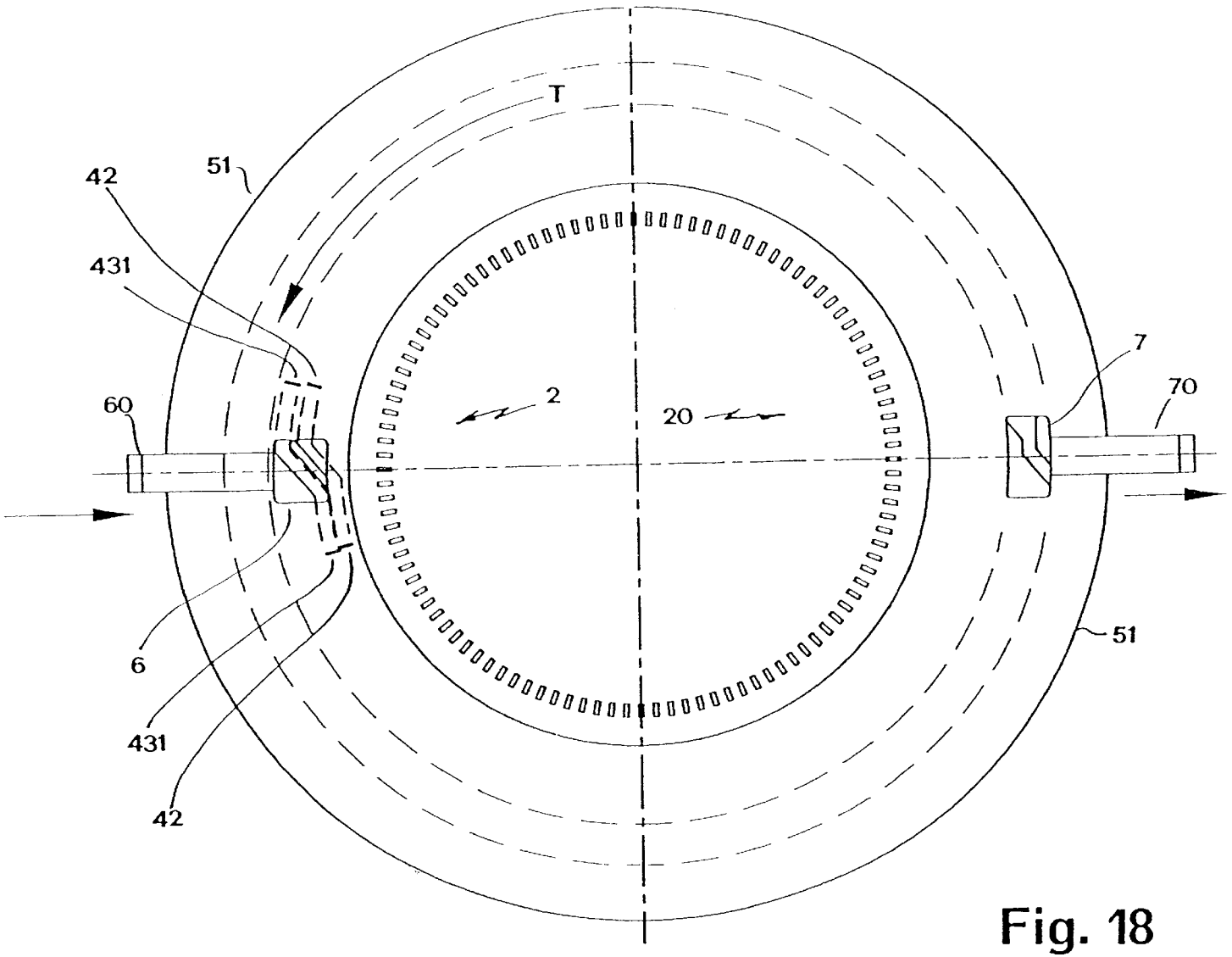
FIG. 18 is in plan view, the textile machine of the circular knitting machine, showing the needles (2, 20) and the sinkers cover (51) on which the sliding cams (6, 7) are mounted for the operation of the stitches-removing and transferring members—the cam on the left side in the figure being provided for moving said members close to the working area of the needles and the cam (7) on the right side serving to move said members away therefrom—the trajectory, indicated by the arrow T, of the members for the removal and transfer of the stitches and, indicated by dotted lines in correspondence of cam (6), the trajectory of the portions of these members associated to the cam (6)
Figure 19:
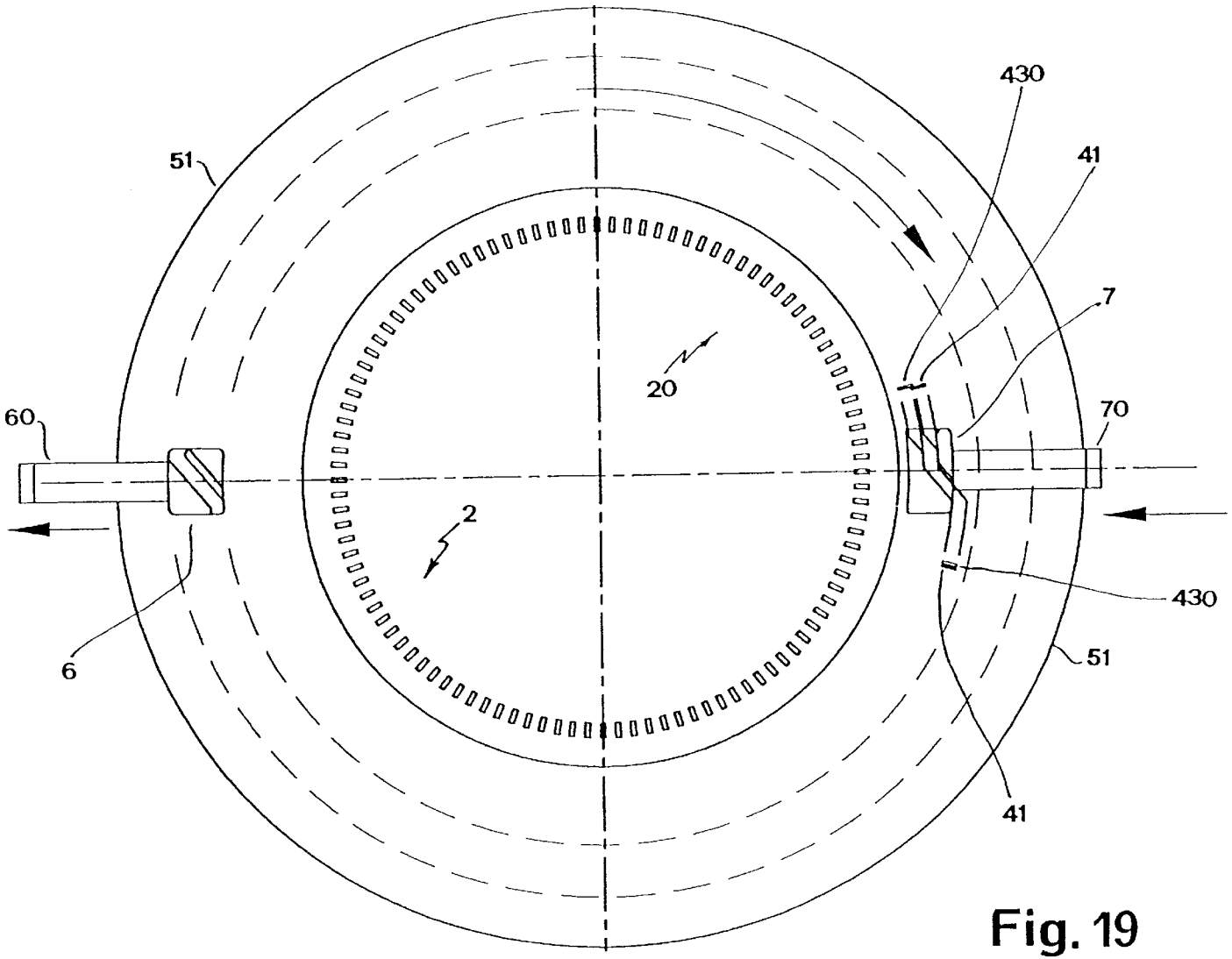
FIG. 19 is a view similar to FIG. 18 but showing the cam (6) out of operation and the cam (7) in operation.
Figure 20:
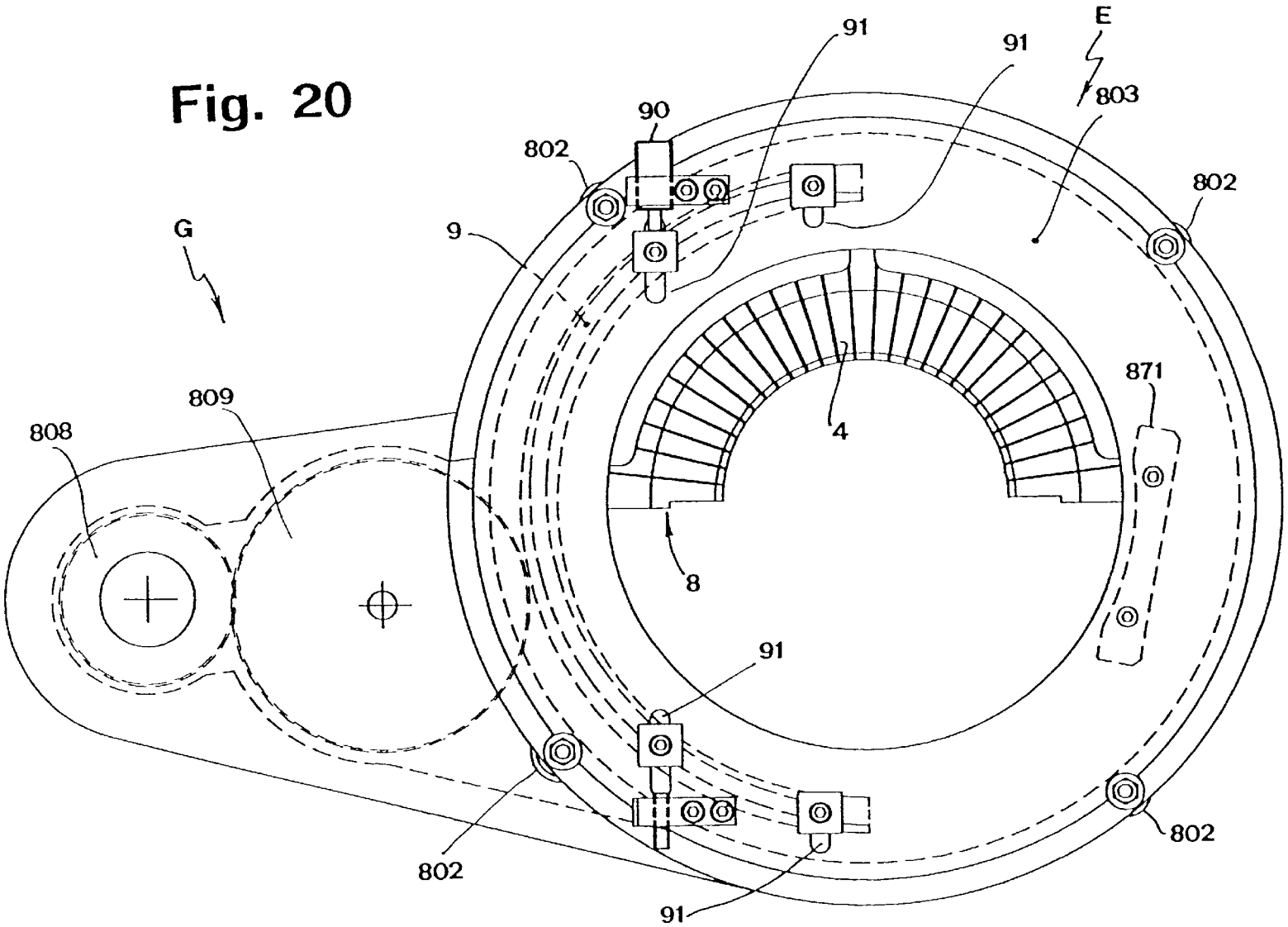
FIG. 20 shows in plan view the movable unit (E) with the respective bearing arm (G), with the above said semicrown (8), means (808, 809) for the transmission of motion of the needles cylinder to the semicrown, the cam (9) for overturning the semicrown (8) and respective drive means (90) and slide guide means (91)
Figure 21:
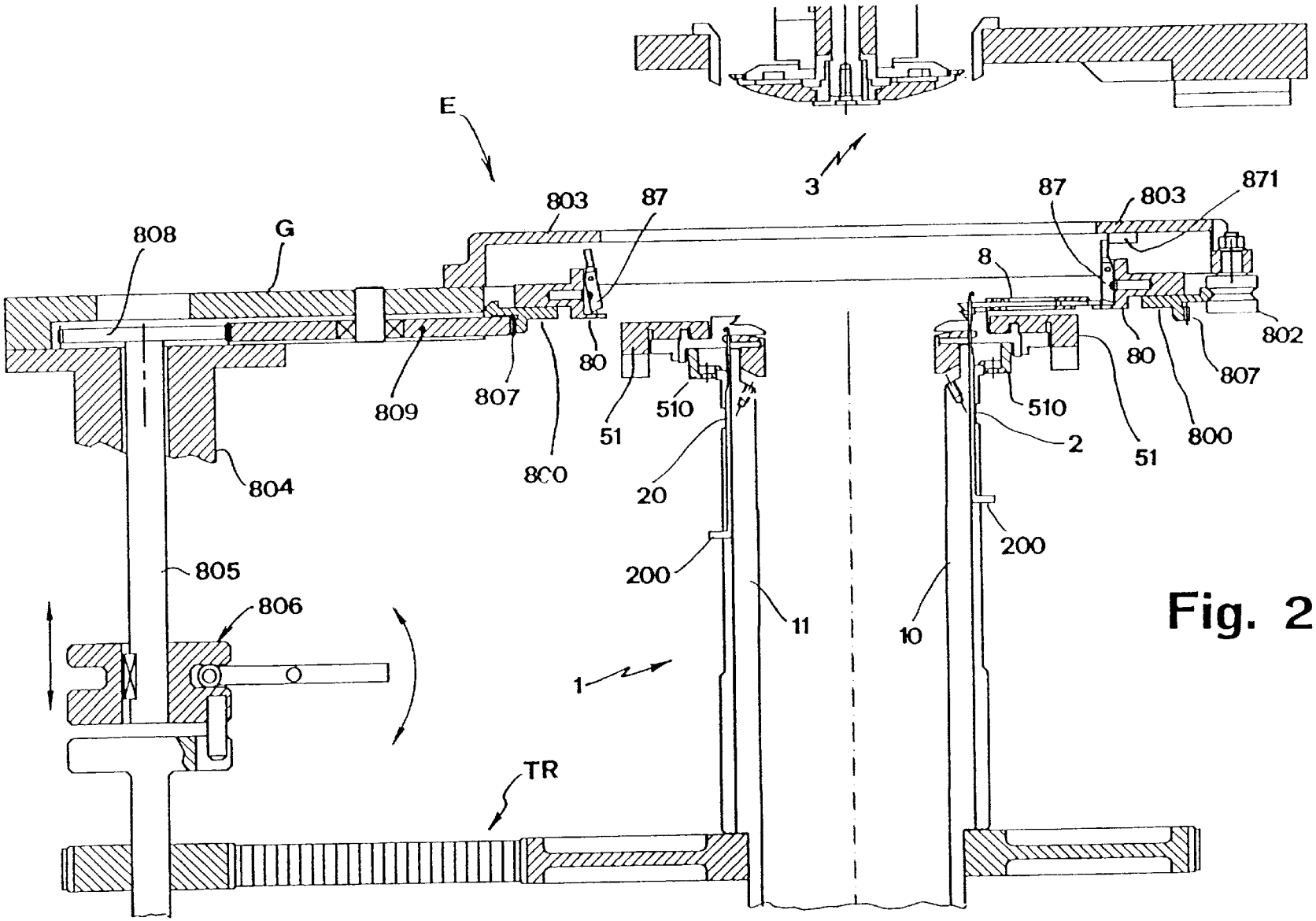
FIG. 21 is a section view of the knitting machine, with the apparatus according to the invention in operating condition and the plate (3) outside the working area of the needles, which also shows the ring (800) for supporting the semicrown (8) and the means for driving the semicrown into motion.

Moreover, advantageously, able to be associated to each of said flat removal members (4) is a movable element apt to completely and irreversibly close the end hook (40) so as to form an eyelet (OR) for retaining the stitches to be taken out and moved on. According to a first embodiment, these elements for the closing of the hook (40) are made up of flat members (43) disposed side-by-side to the main members (4), also received into corresponding guiding slits formed in the semicrown (8) and provided with heels (430, 431) to allow them to be driven from and to the needles (2, 20) by means of said cams (6, 7). Alternatively, the member for closing the hook (40) of each flat element (4) may consist of a curved, flexible, elastic, filiform body (44)—shown only in FIG. 17L for the sake of simplicity—having its concavity turned opposite to the hook (40) and being welded to the hook (40) and with its free end extending beyond the corresponding end of the flat element (4) During the fabric-gripping step, the body (44), owing to its elasticity, moves away spontaneously from the hook (40) to take up, again spontaneously, the initial covering condition after said gripping has taken place. Moreover, during the overturning of the semicrown (8), the covering of the hook (40) is e sufficient to avoid the spontaneous removal of the engaged fabric, whereas, upon the transfer of the same fabric onto the second-series needles (20), the force exerted by theese needles (20) will be sufficient to drive the body (44) away from the position for the covering of the hook (40), which hook will again move to the initial covering position after said transfer.

Figure 25:
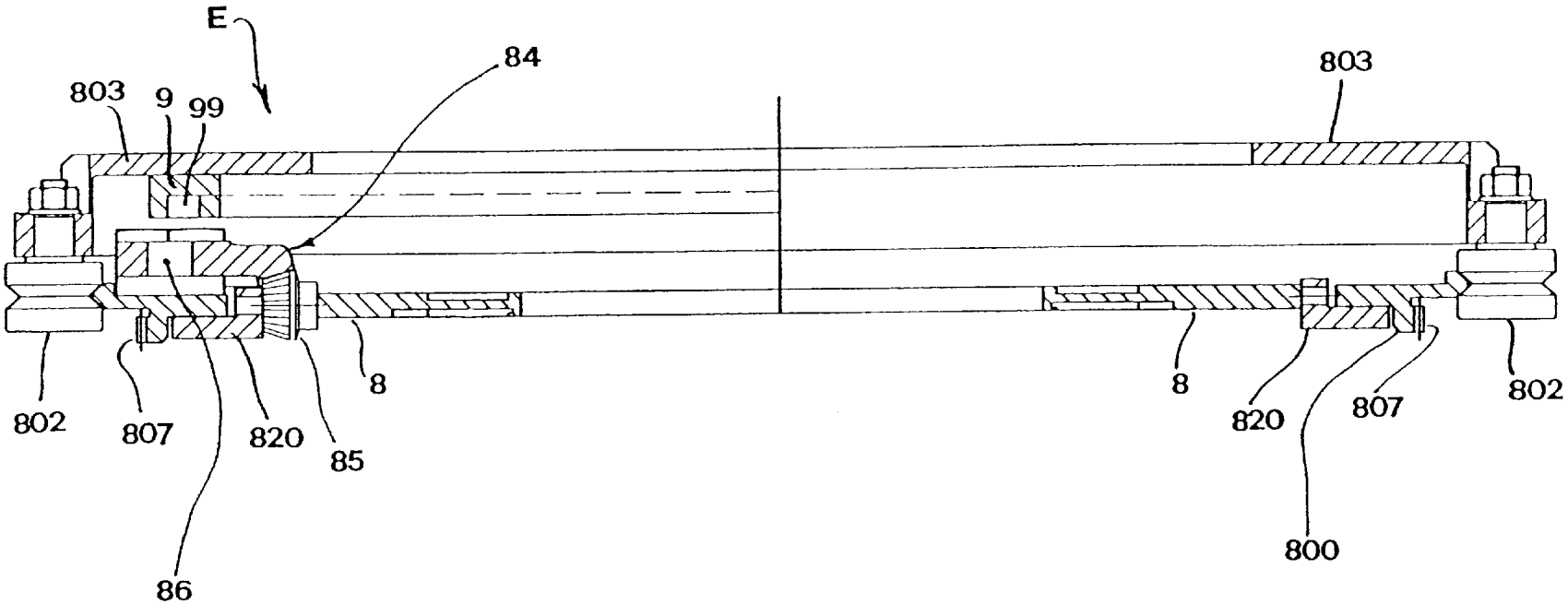
FIG. 25 shows a section view of the movable unit (E)
Figure 27:
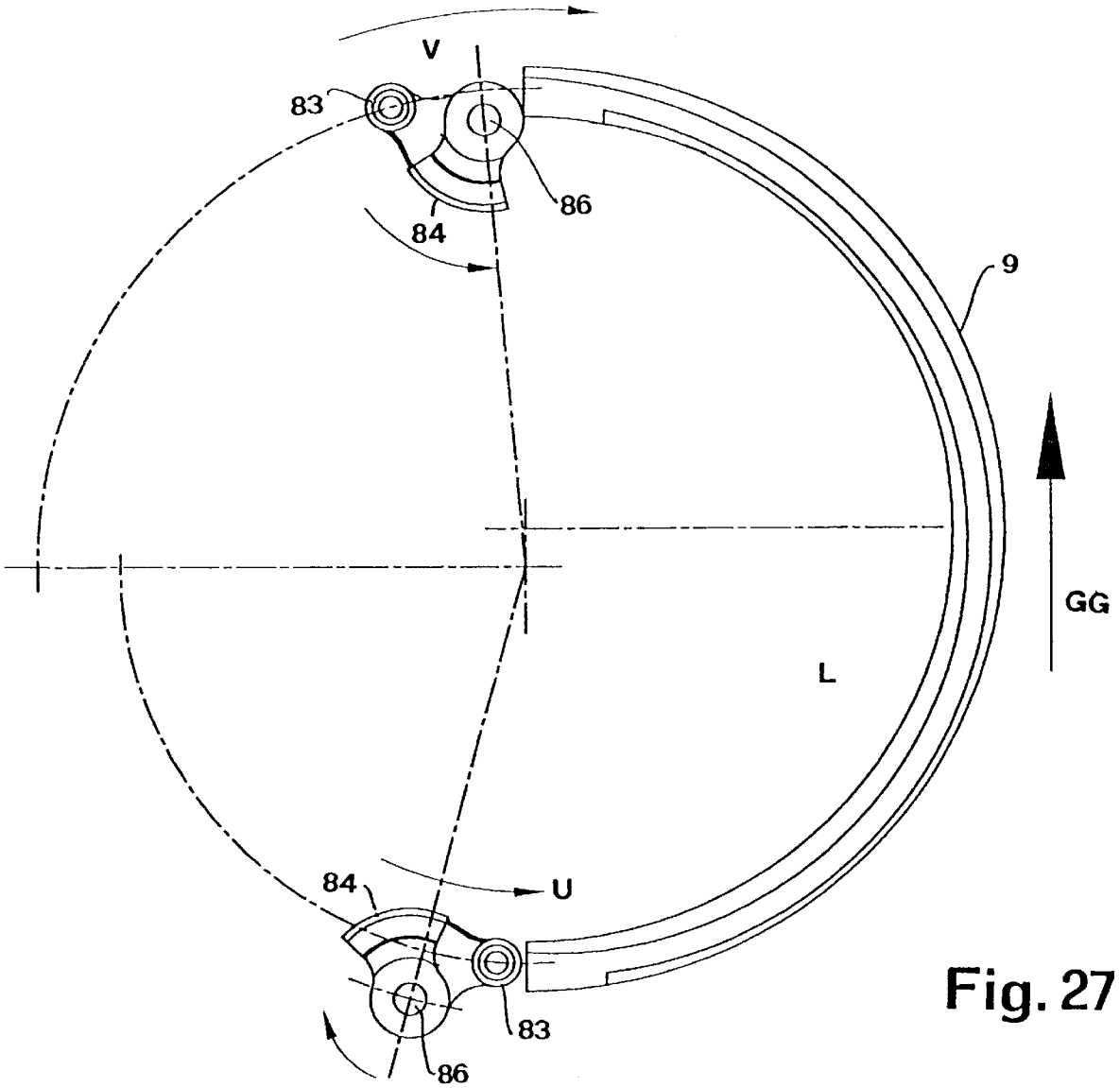
FIG. 27 shows a diagram like that in FIG. 26, with the cam (9) for the overturning of the semicrown (8) being in operative condition.
Figure 28C:
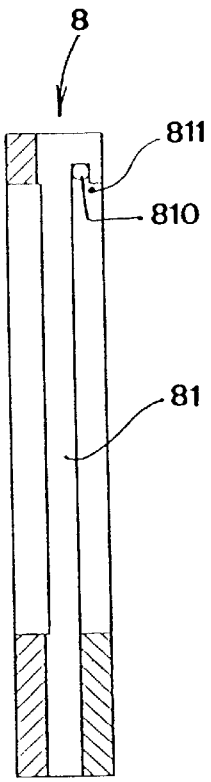
FIGS. 28A–28C show a front view, a plan view and a section view on line N—N, of the semicrown (8)
Figure 28B:
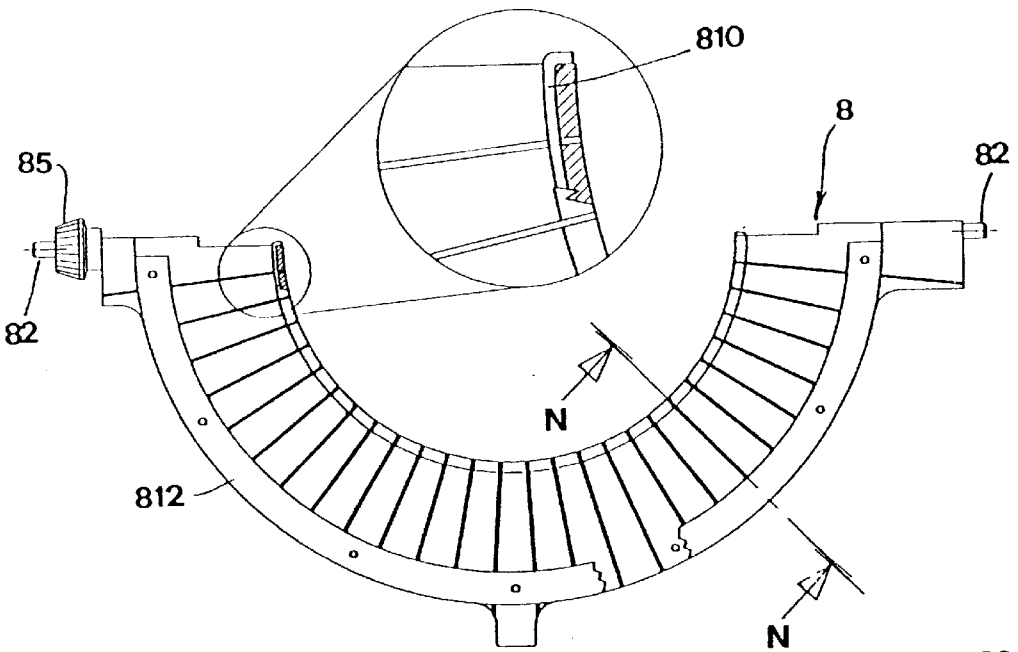
Figure 28A:
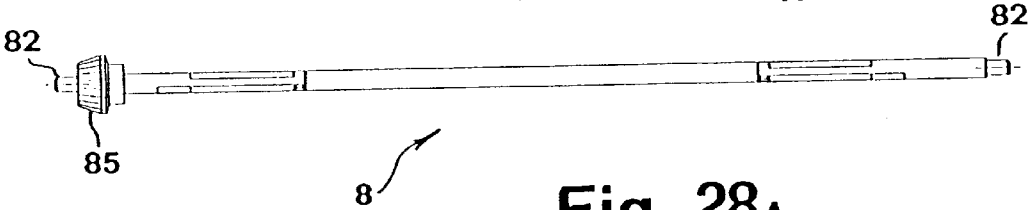
Figure 29B:
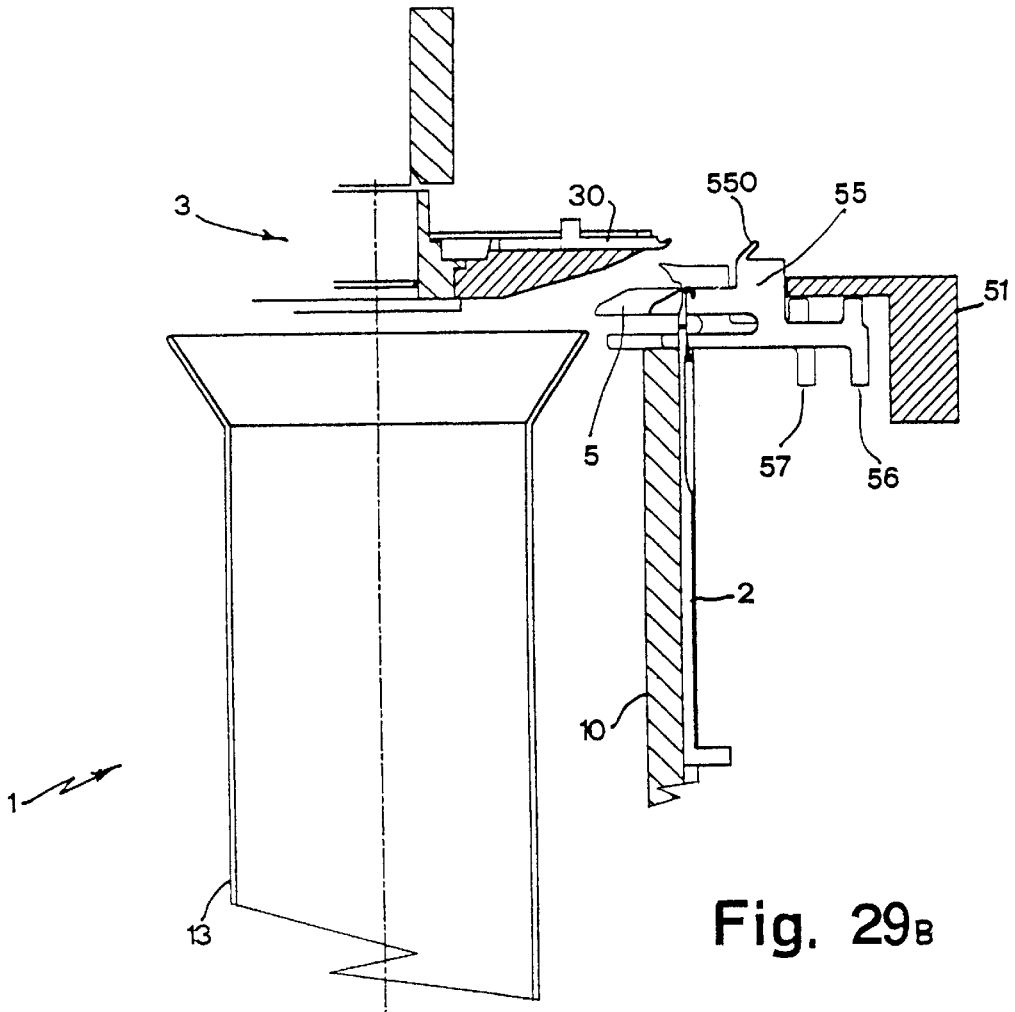
FIGS. 29A and 29B show, respectively, a cutaway plan view and a sectional view on line Q—Q of the textile head of the machine embodying an apparatus according to the invention, with means for a temporary support of the stitches already formed by the hooks of the plate, according to an alternative embodiment.
Figure 29A:
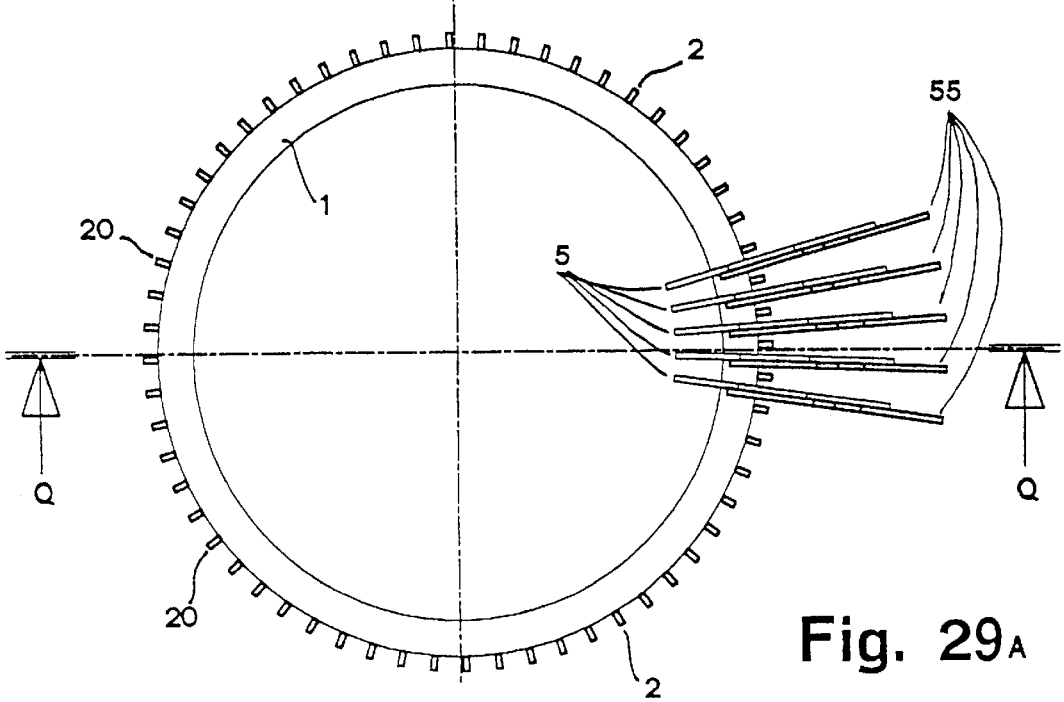
Figure 31:
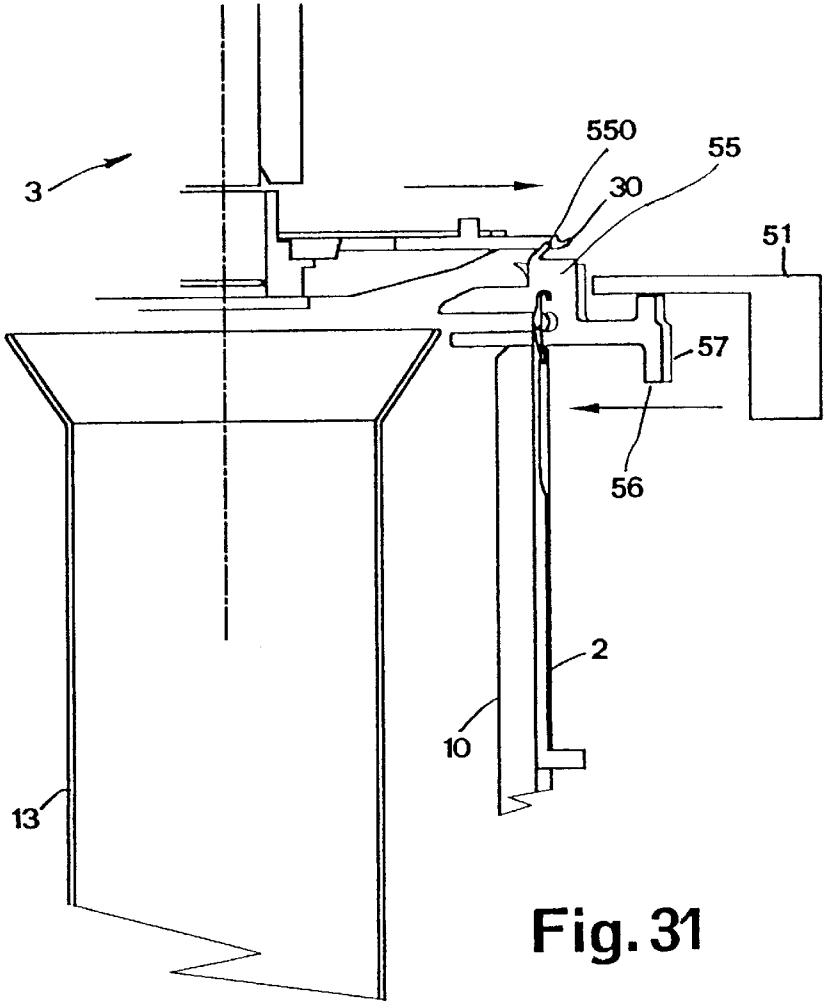
FIGS. 30–36 show schematically the operating steps of the method according to the invention, in a sequence corresponding to a further possible embodiment.
Figure 30:
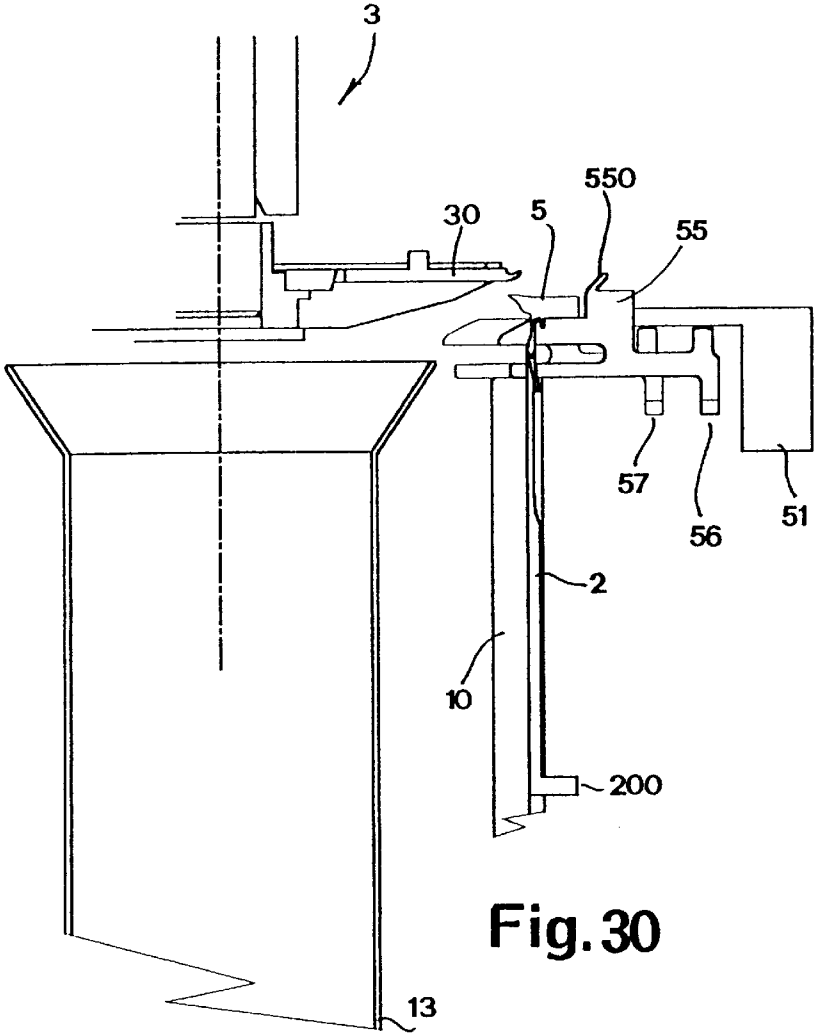
Figure 32:
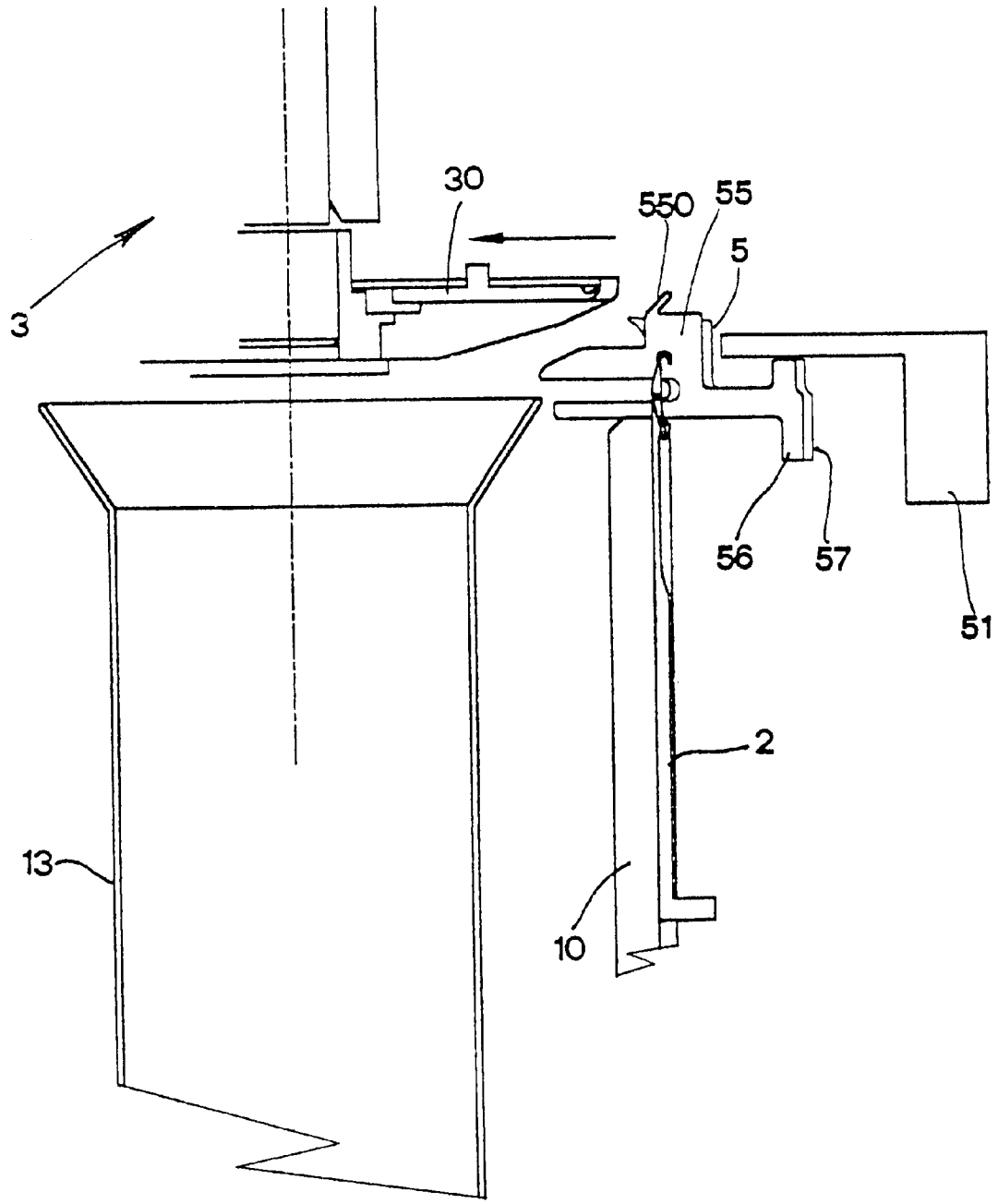
Figure 33:
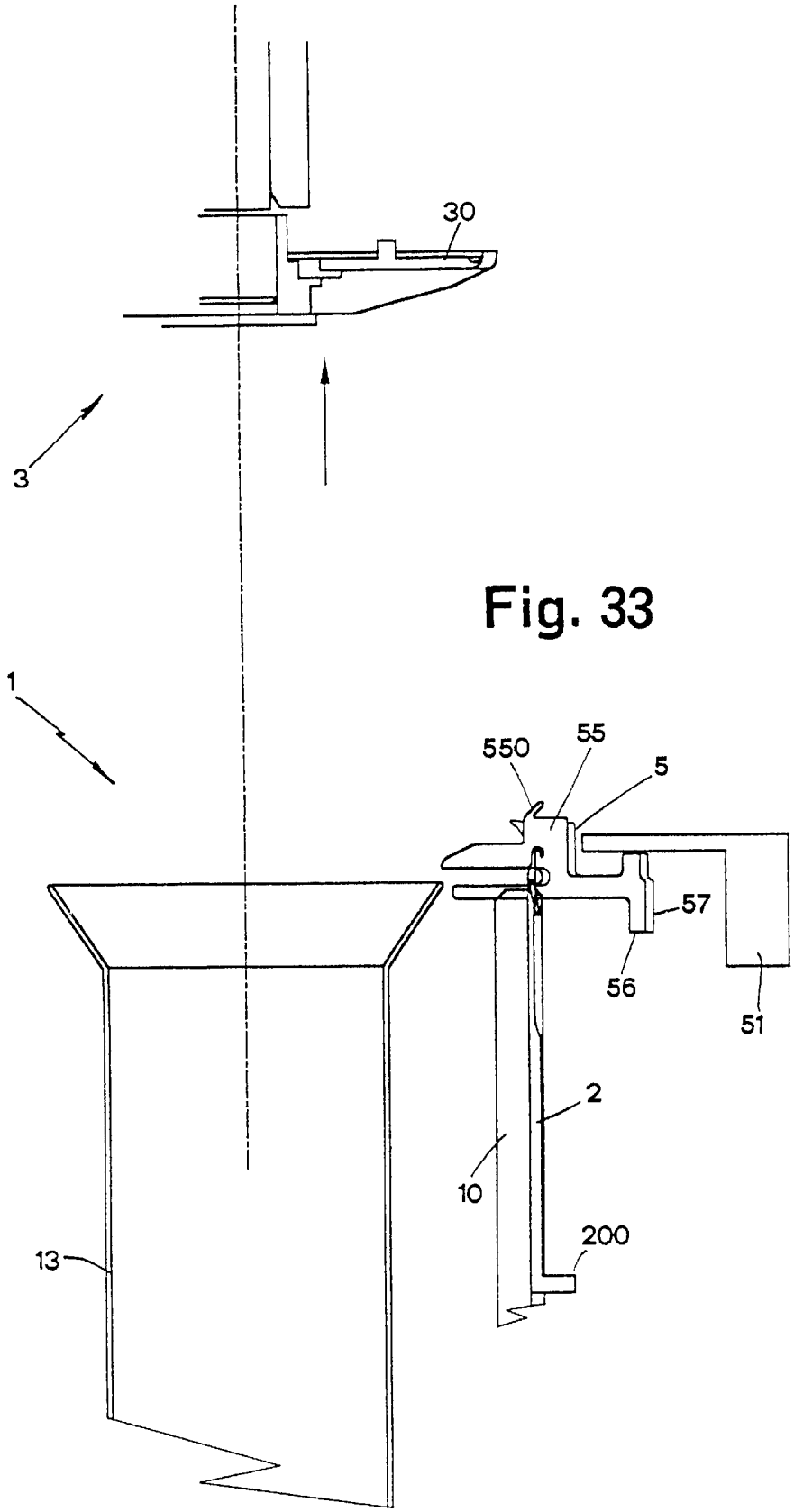
Figure 34:
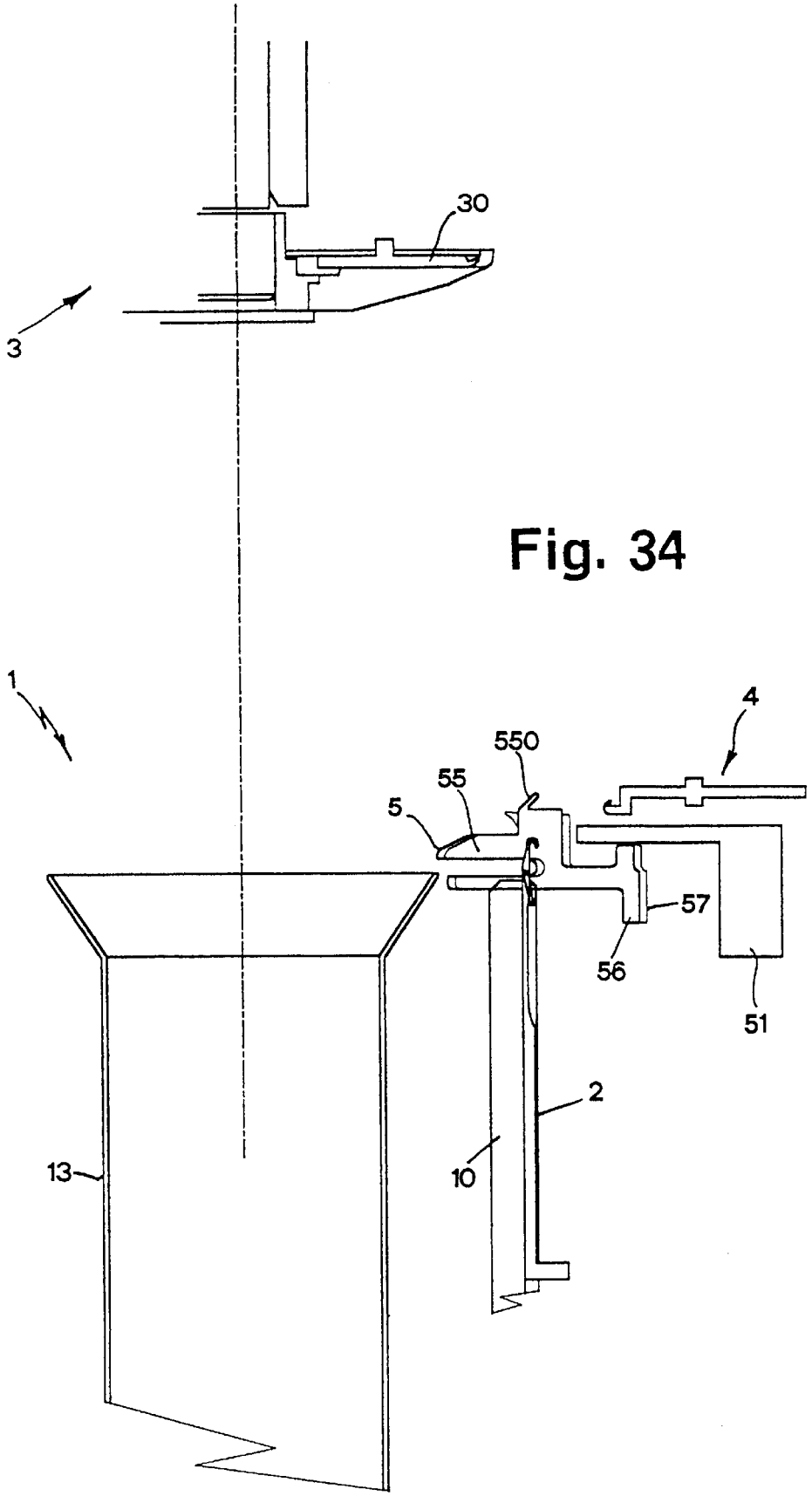
Figure 35:
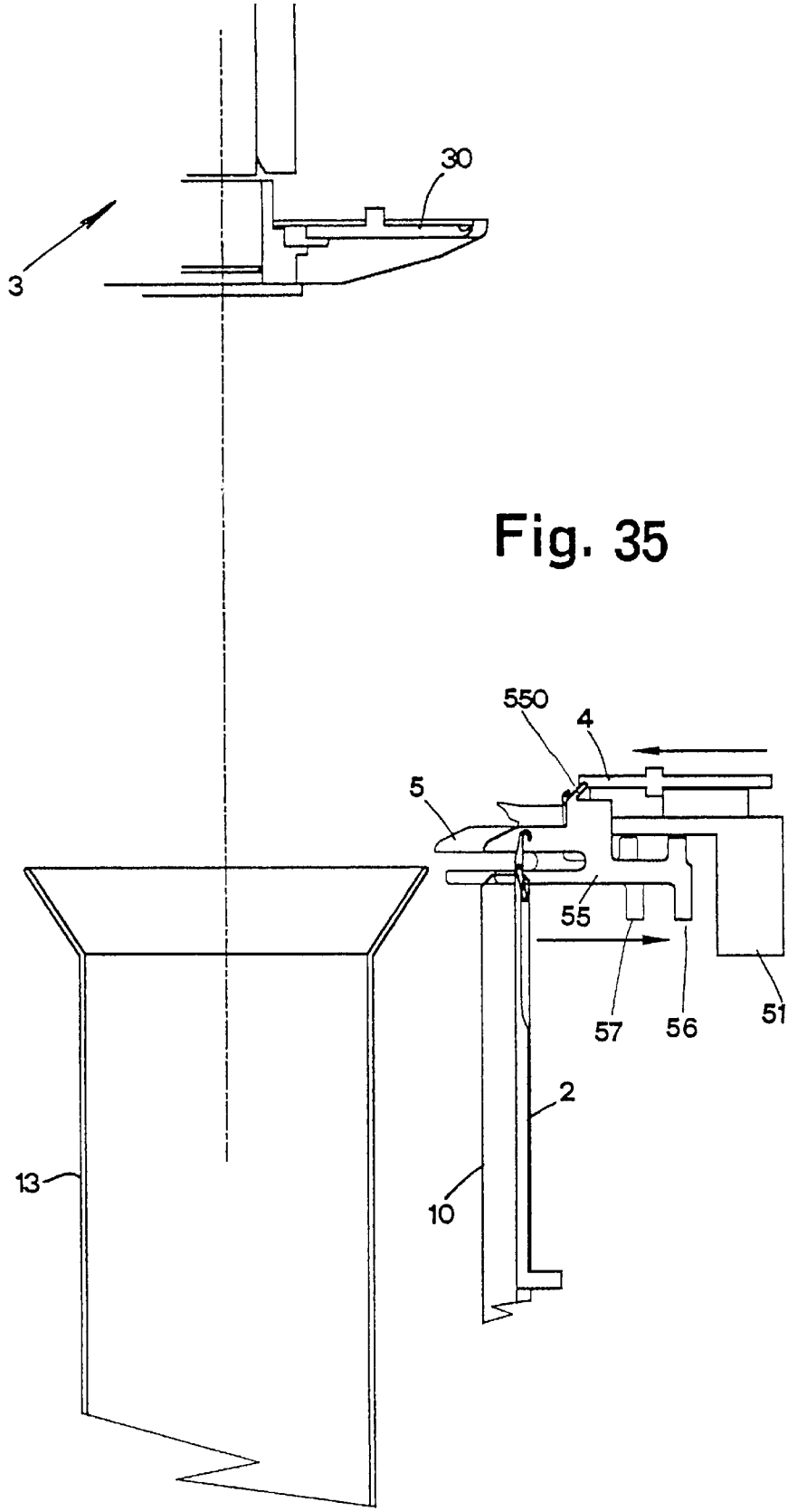
Figure 36:
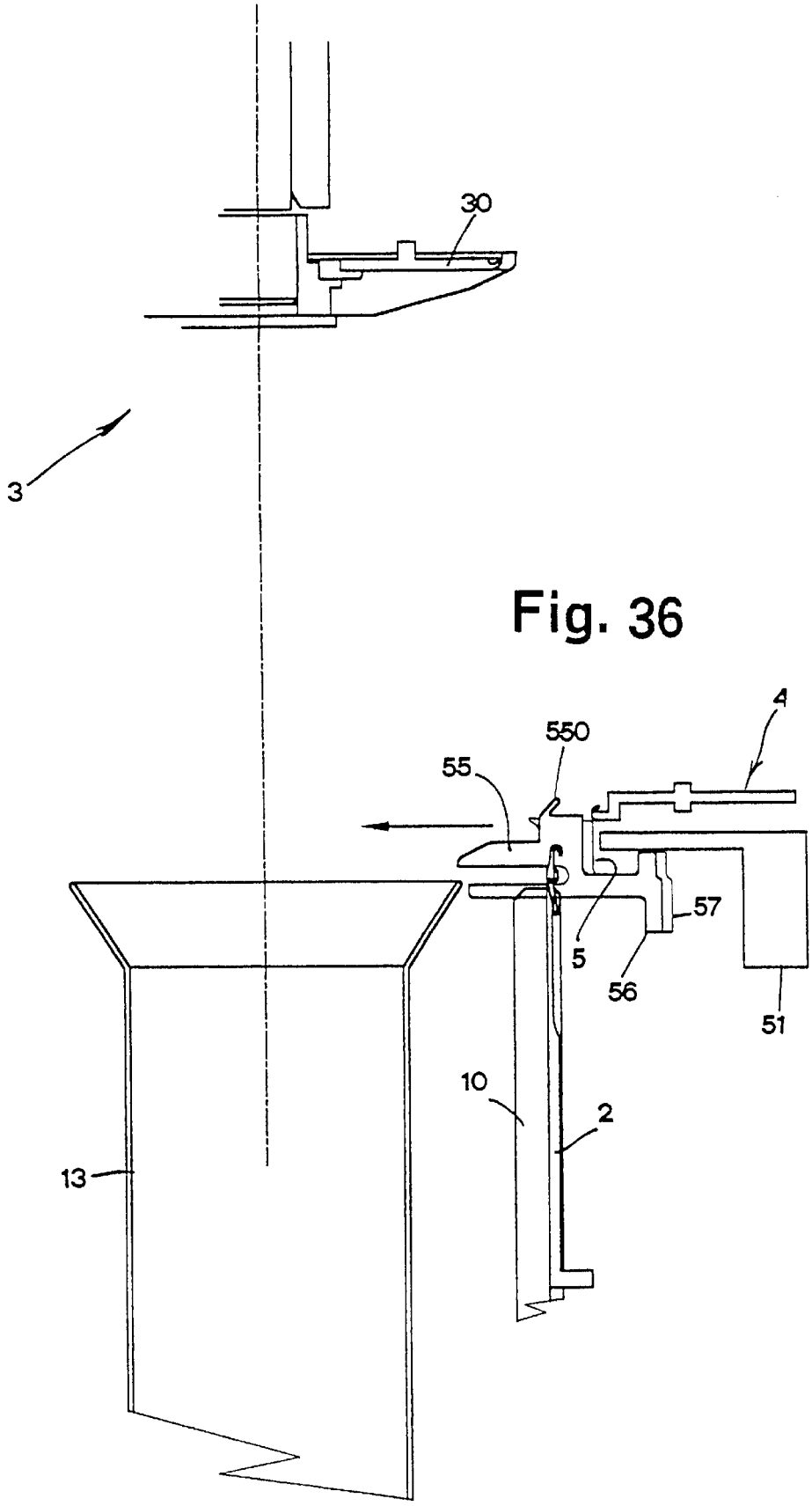

The means for operating the 180°-overturning of the semicrown (8) comprise, according to the example shown in the figures of the accompanying drawings, a cam (9) of spiroidal profile, developed along a semicircumference external to the semicrown (8) and having a cross-section shaped as a reverse "U" (as illustrated in FIG. 25), mounted for sliding within suitable guide slots (91) provided on the cover (803) of the movable unit (E) and associated to an actuator controlling the translation thereof parallel to itself—as indicated by the arrow GG in FIG. 27—to dispose it to a first, stand-by position (K) and to a second, operative position (L): the said cam (9) having the function to engage, by its inner groove (99), in a condition suitable for overturning the semicrown (8), a pivot (83) (or other equivalent, substantially cylindrical member) carried by a sector gear (84) with conical toothing meshing with a pinion (85) solid to the semicrown (8). In FIG. 25, said pivot (83) is not represented for the sake of clarity, but the figure does represent the pivot (86) for pivoting the sector gear (84).

The overturning of the semicrown (8) is obtained by disposing the cam (9) at position (L) of FIG. 27.

With the cam (9) in this position, and with the rotation of the semicrown (8) about the axis of cylinder (1)—this rotation being caused by the shaft (805) via the transmission (808, 809, 800) as previously indicated—the pivot (83) of the sector gear (84) is intercepted by the cam (9), that is, it fits into the groove (9) of the same cam. This drives the sector (84) into rotation about its own pivoting axis and, since said sector (84) is in meshing engagement with the pinion (85), the latter is driven into a corresponding rotation about its longitudinal axis which, therefore, causes the rotation, about the axis (R-R), of the semicrown (8) to which the pinion (85) is solid.

Figure 26:
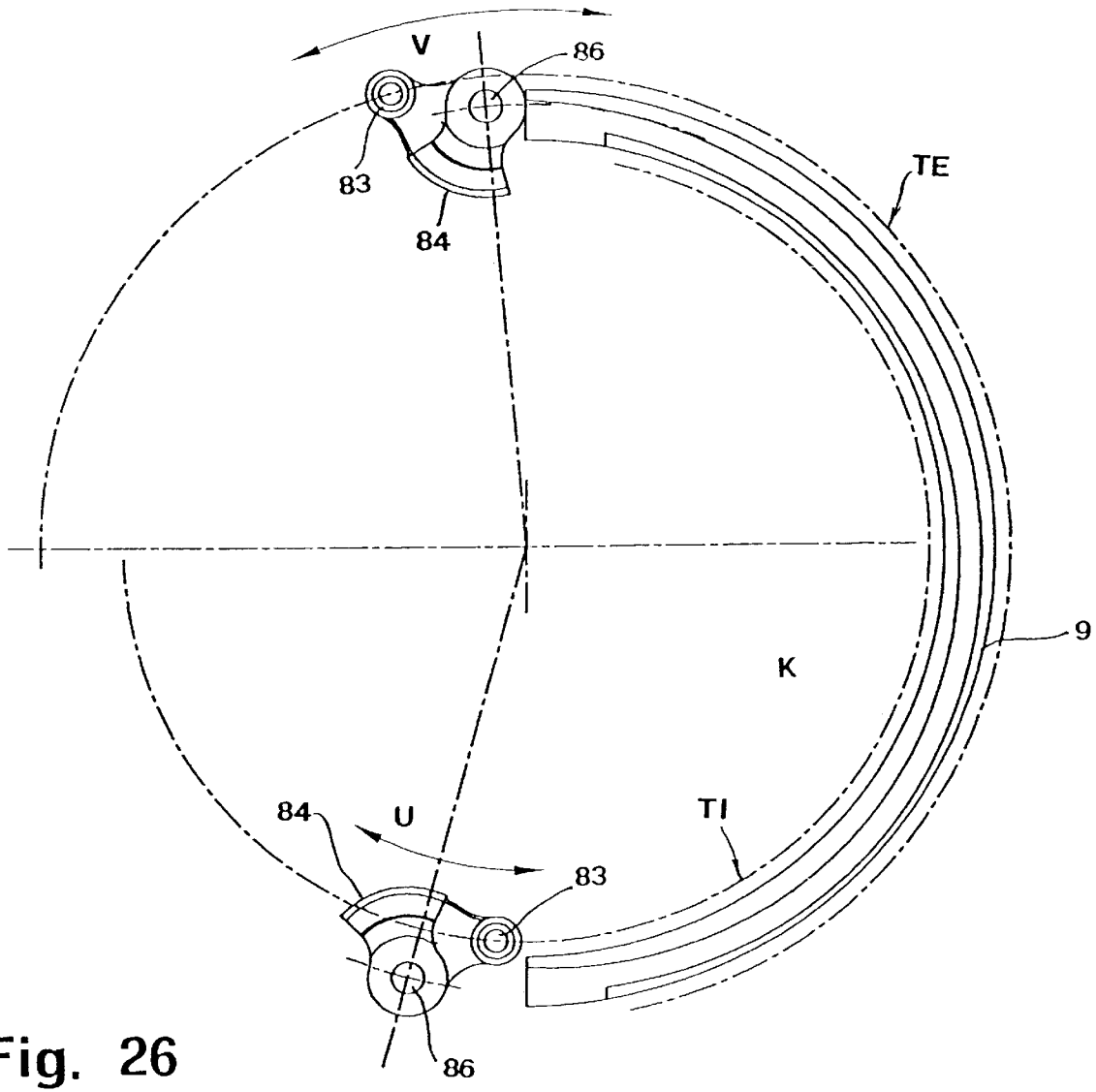
FIG. 26 shows a diagram relevant to the operation of the means which provide for the overturning of the semicrown (8), in a condition in which the inoperative cam (9) does not hinder the transit of the pivot (83) both before and after the overturning of the semicrown (positions U and V, respectively), that is, when the pivot (83) follows either the inner (TI) or outer (TE) trajectory.

With the cam (9) at position K in the scheme of FIG. 26, the pivot (83) is not intercepted by the same cam (9) and, therefore, the rotation of the semicrown (8) about the axis of cylinder (1) does not involve the overturning thereof.

Figure 22:
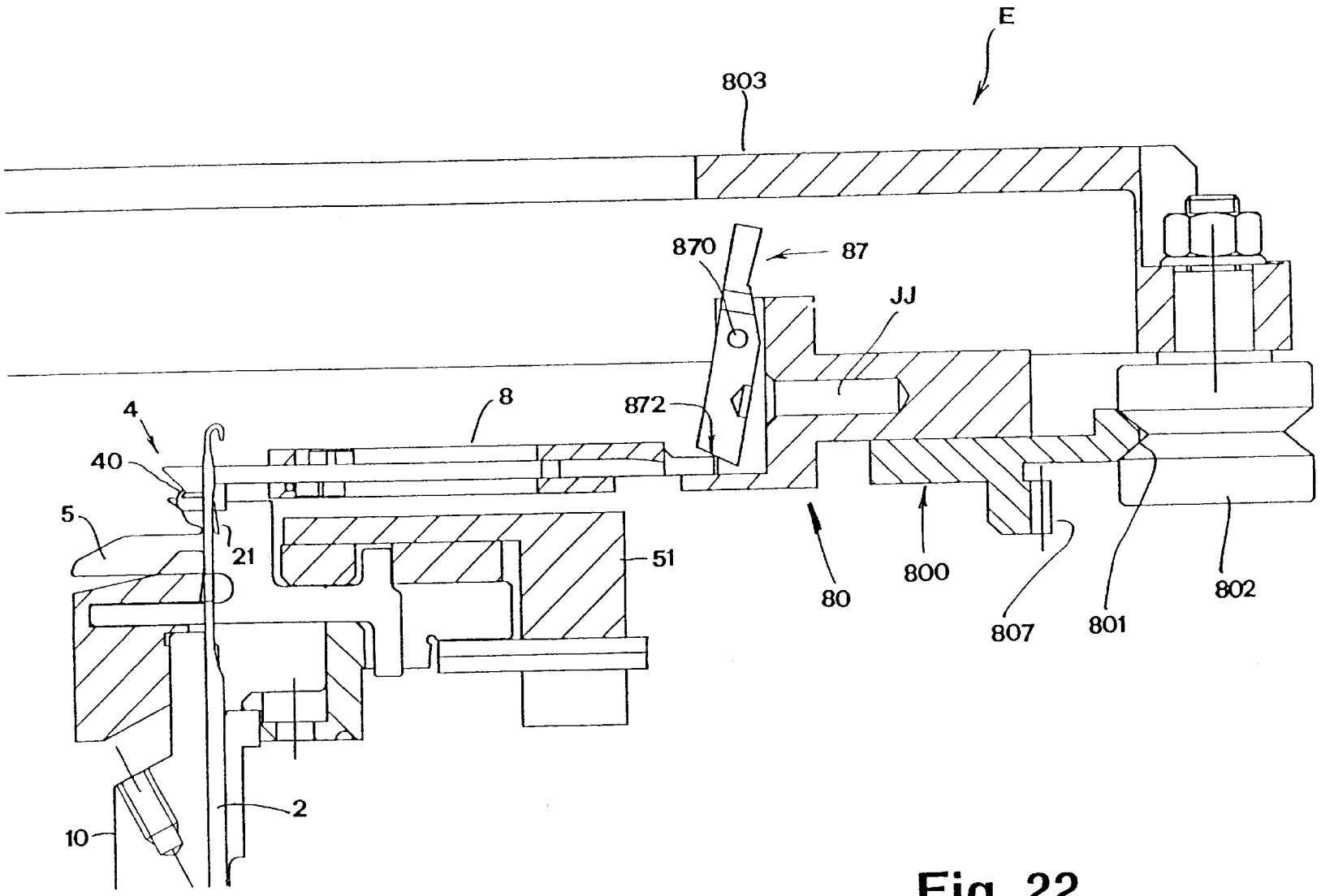
FIG. 22 shows an enlarged detail of the means of FIG. 21.
Figure 23:
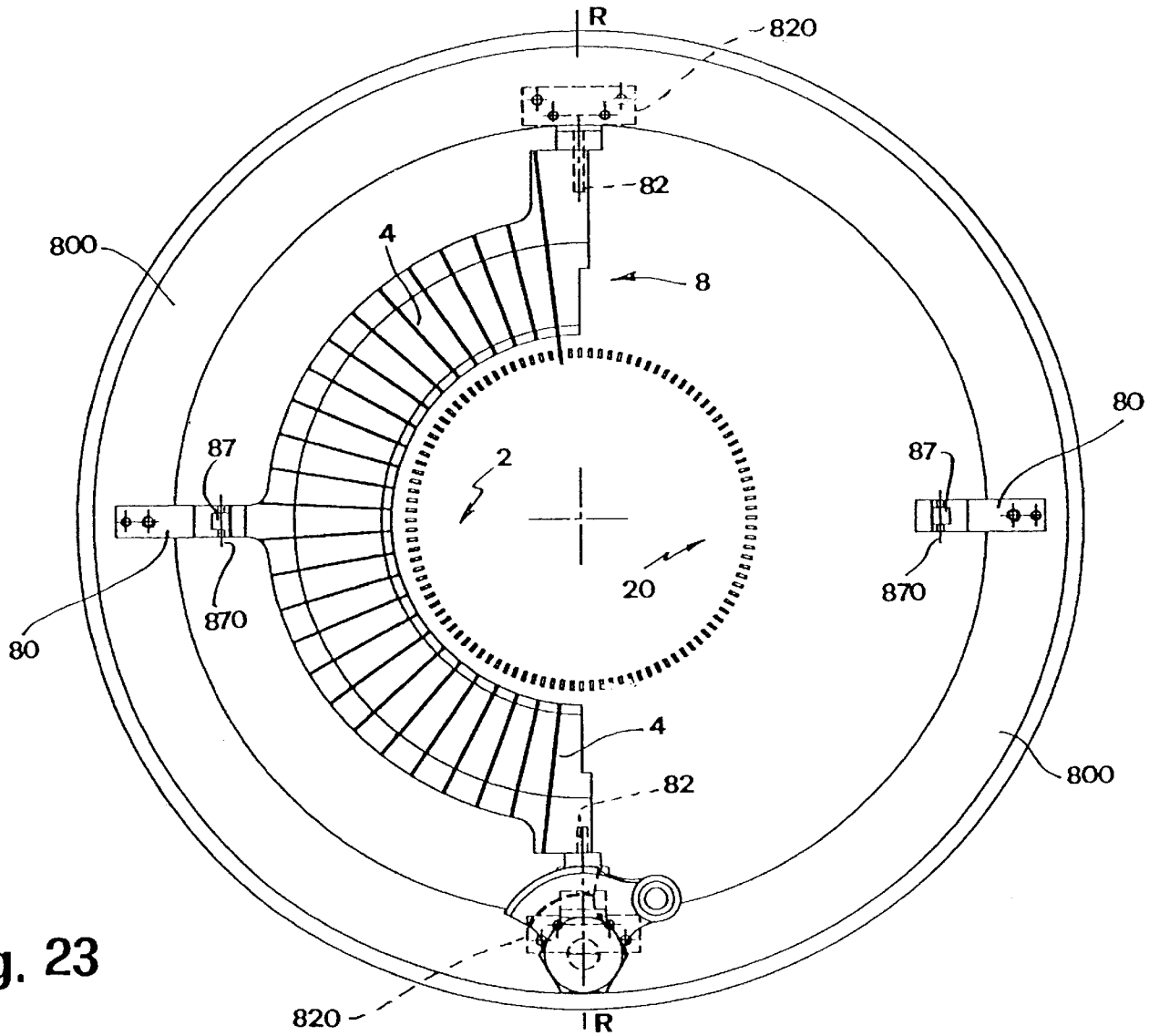
FIG. 23 is a plan view of the stitches-removing and transferring members and of the means which operate the overturning of the semicrown (8), in a stitches-removing attitude.
Figure 24:
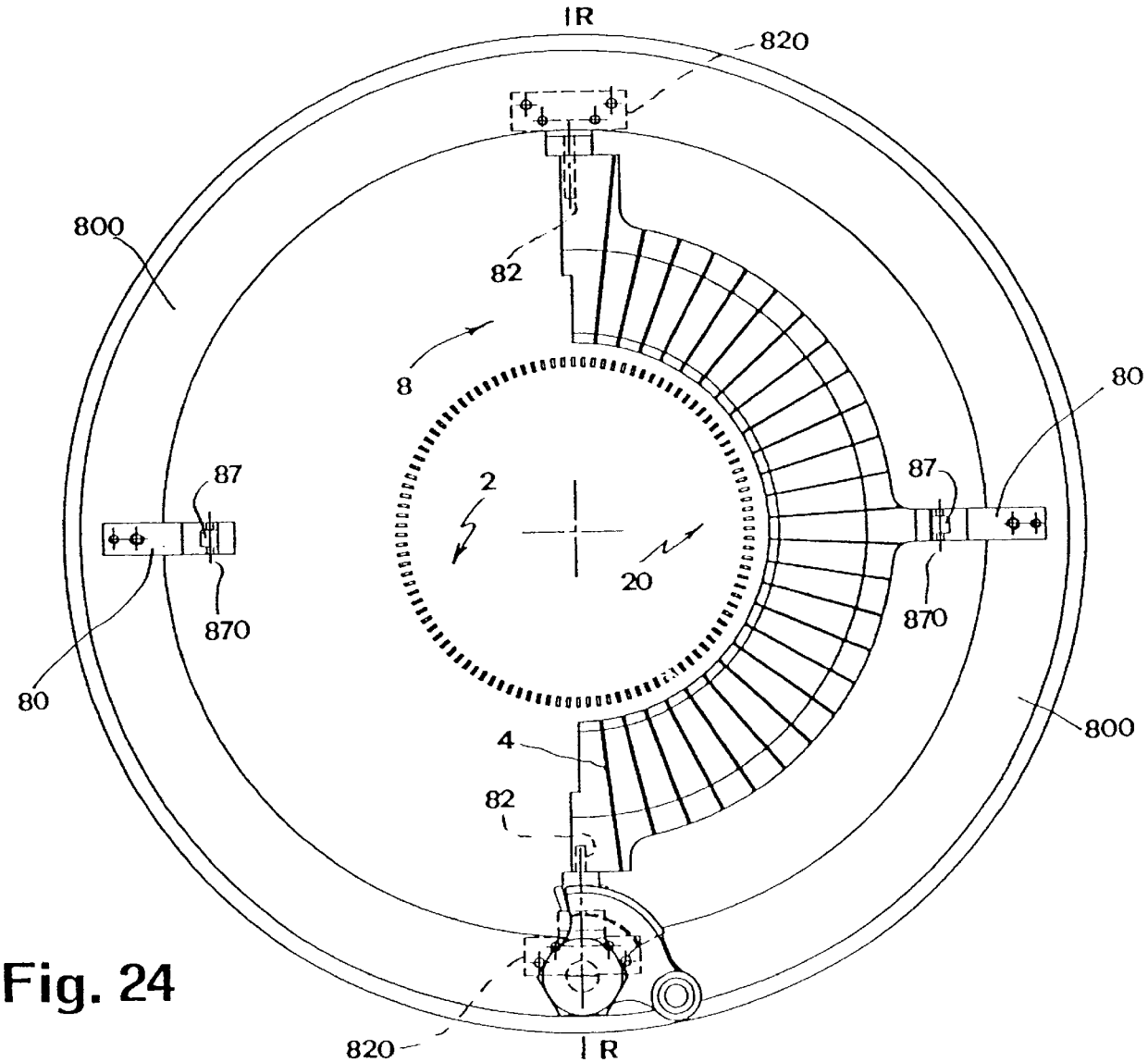
FIG. 24 shows the means of FIG. 23 after the overturning of the semicrown (8)

Means are also provided to maintain said semicrown (8) adherent to support blocks (80) in an unallowed overturning attitude, with a lever (87) able to rotate about the axis of the pivot (870), trasversally borne by each block (80), and associated to a fixed cam (871) solid to the inner surface of the cover (803): the lower free end (872) of the lever (87) intended to be put in contact with a corresponding portion of the outer edge of the semicrown (8) (as illustrated in FIG. 22) in adhering attitude with blocks (80). The lever (80) is normally kept in the position shown in FIG. 22 by a spring (FIG. 22 indicating the axis JJ thereof) housed in each of blocks (80).

By the rotation of the semicrown (8) about the axis of the cylinder, when the lever (87) is intercepted by the cam (871), the same lever is caused to rotate about the axis (870), so that the end (872) moves away from the outer edge of the semicrown (8) for its disengagement therefrom. In this condition, if the cam (9) is in the active position (L), then the overturning of the semicrown (8) is allowed.

By way of a not-limiting example, the description below refers to working steps for the manufacturing of a stocking according to a feasible embodiment of the present invention.

In the first place, there is carried out the knitting of the pocket (ST) representing the fabric portion of the stocking intended to form the toe, by using only the needles (2) of the first series so that the free edge (the upper one in the figures of the attached drawings) of the pocket (ST) will, as a result, be suspended to the hooks (30) of plate (3). Upon completion of this knitting step, the end of the pocket (ST) suspended to the hooks (30) of plate (3) is transferred onto the needles (2) which also have the stitches of the other end thereon. To this end, the hooks (30) are moved in centrifugal direction to bring the fabric of the corresponding portion of pocket (ST) close to needles (2), and these are raised up to penetrate the fabric, through the spaces between the hooks (30), and reach such a height as to have this fabric below the respective tongues (21). Thereafter, the hooks (30) of plate (3) are moved back to the respective initial positions, by means of the relevant driving cams, with a motion opposite to the previous one and, afterwards, the plate (3) is lifted up to be moved away from the working area of the neeldes. Then, the semicrown (8), carried by the movable unit (E), is transferred to the knitting station (Y) and so positioned as to result coaxial to the cylinder (1) of needles (2, 20). Thereafter, the members (4) for gripping the fabric already suspended to the hooks (30) are made to advance centripetally in succession for a travel of predetermined length, within the respective housings provided in the semicrown (8), by means of the cam (6) and with a rotation of the support (800), this rotation being derived from the shaft (805) via the transmission (807, 808, 809). Then, the needles (2) are lowered so as to make said stitches rest on the members (4), in correspondence of hooks (40), to perform the unloading of same stitches, that is, their being taken over by the members (4). Following this operation, the stitches transferred from the needles (2) to the members (4) are brought back onto the needles (20) of the second series, by a 180° rotation of the semicrown (8) about the axis (R—R) and subsequent elongation of the fabric operated by the same members (4) which, by means of cam (7), are made to retract, that is, moved in centrifugal direction to dispose themselves in the respective initial positions taken up prior to the removal of the stitches. The needles (20) of the second series are thus lifted up, to penetrate the edge of fabric now standing above, and then lowered to drive it downwards to release the stitches from the grip of members (4) which, afterwards, are brought back to the respective initial positions through a movement opposite to the preceding one. The movable unit (E) is transferred again to the station (Z), the plate (3) is brought back to its initial condition in order to keep on with the knitting of the article which will thus result with its toe already closed.

According to a further embodiment, the stitches already suspended to hooks (30) of the plate (3) may be transferred, instead of onto the needles (2) of the first series, onto other members—for example, a front of spines formed by upper appendices of the sinkers (5)—able in any case to make up means for temporary supporting this fabric portion of the pocket (ST) and yet connected to the textile head of the machine, that is, disengaged from the plate (3) to allow the latter to be moved away upon operating the positioning of the movable unit (E), by means of the semicrown (8), in correspondence of the machine's textile head. In a further embodiment, the said means for temporary supporting said fabric portion of the pocket (ST) may consist of means separated from those operating the very formation of said pocket (ST), but still associated thereto. For example, they might be a series of either stationary or movable members sideway disposed to the sinkers (5) or even to the needles (2) of the first series. More in particular, as shown in FIGS. 29A–36 of the attached drawings, the means for temporary supporting the stitches already suspended to the hooks (30) of plate (3) may also consist of a plurality of flat members (55) of a shape substantially equal to that of sinkers (5) and with an upper appendix (550) so dimensioned and shaped as to allow the stitches dispose thereon to be unloaded from said hooks (30), to allow the plate (3) with hooks (30) to be moved away and the removal members (4) to intervene. Said flat members may be arranged in such positions as to result sideway disposed to corresponding sinkers (5) and be provided with actuation heels (56), like those (57) of sinkers (5), operable by cam means—not shown in the drawings for sake of simplicity—associated to the sinkers housing (51) and acting on said heels in the same way as they do on sinkers (5).

The succession of the operating steps schematiccaly illustrated in FIGS. 30–36 of the accompanying drawings is similar to that relative to the steps previously described with reference to FIGS. 1–8. The only major difference, in this case being that in order to tansfer the stitches from the hooks (30) of plate (3) to the members (55) for the temporary support thereof, provision is made for moving radially, with respect to cylinder (1), both the hooks (30) and the flat members (55) either individually or in combination.

Figure 38:
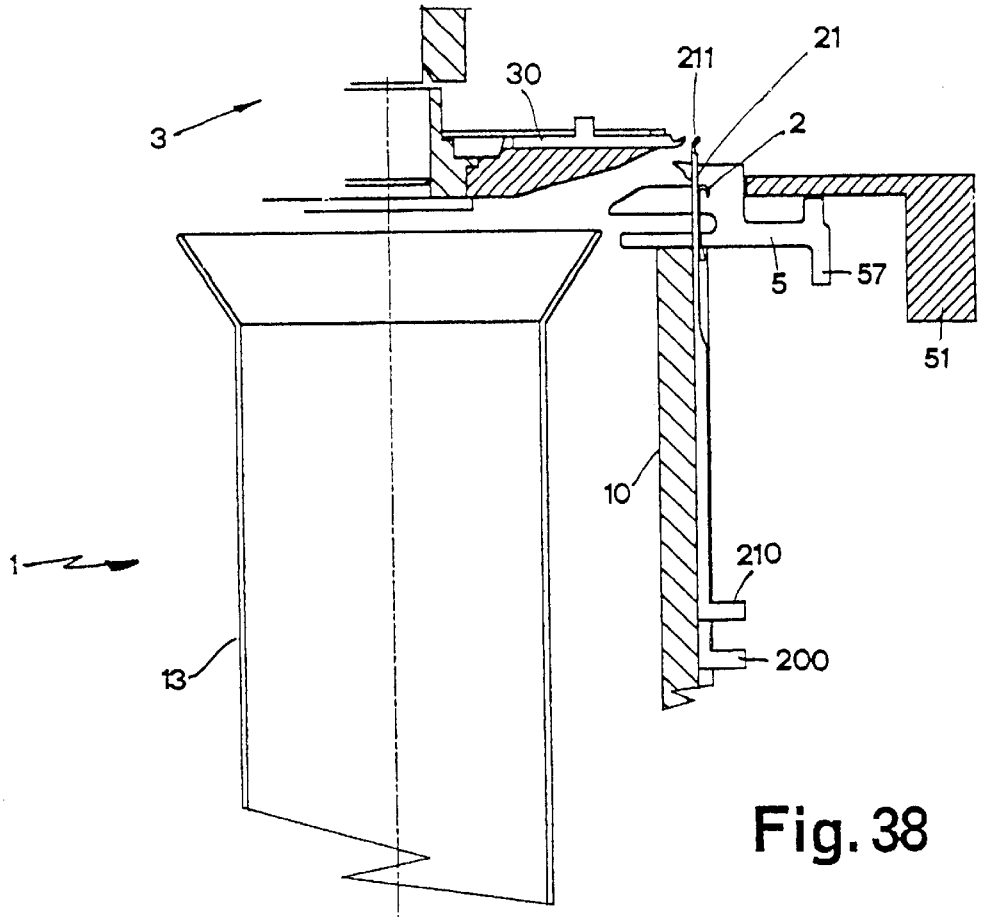
FIGS. 37 and 38 show respectively a cutaway plan view and a sectional view on line T—T of an apparatus according to a further embodiment of the invention.
Figure 37:
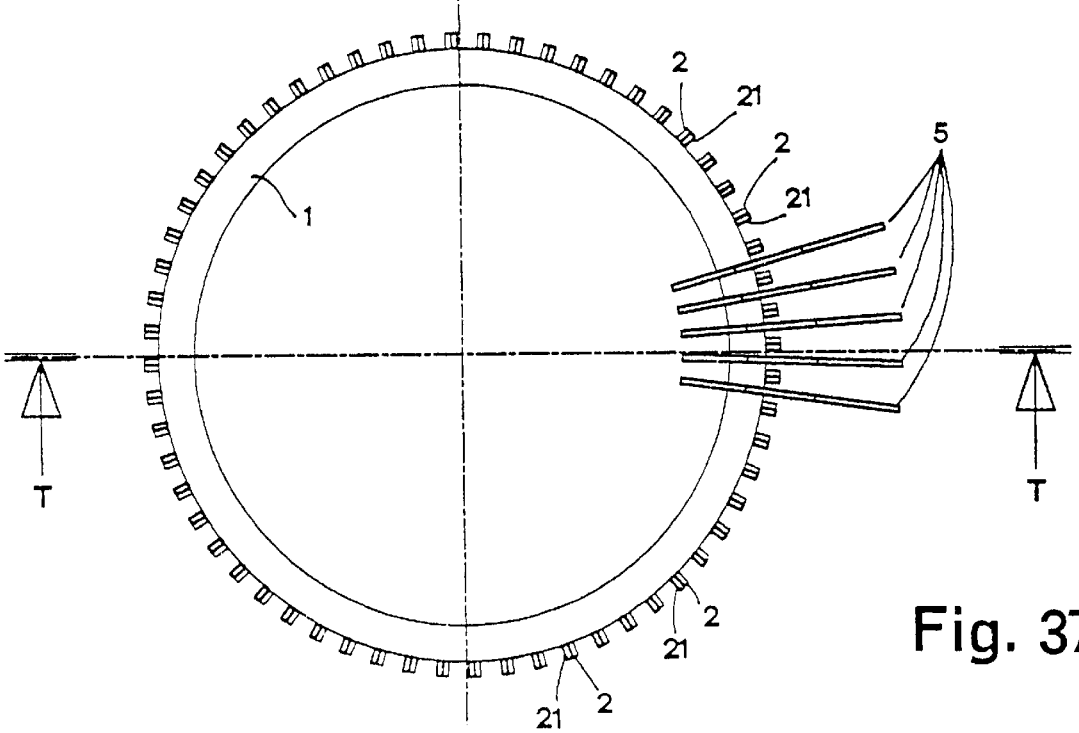

According to a further embodiment of the present apparatus, reference being made to FIGS. 37 and 38 of the accompanying drawings, the means for temporary supporting the stitches already suspended to the hooks (30) of plate (3) comprise a plurality of members (219 shaped likewise the needles (2, 20) and disposed side-by-side to corresponding needles, at least on the portion (10) of the cylinder which the needles (2) of the first series act upon. The said members (21) can be moved by cam means—not shown in the drawings for sake of simplicity—acting on respective actuation heels (210), so as to drive them in motion parallel to the needles of cylinder (1) also exhibiting actuation heels (200) upon which corresponding cam means, not shown in the drawings, are made to act. Said members (219) having an upper appendix (211) able to carry out the same function as the appendix (550) of flat members (55) above described.

As illustrated by way of example in FIGS. 27A–27C of the accompanying drawings, in order to close the seats of removal members (4) on the semicrown (8) the use is made of a wire (810), for example, extending along a corresponding slot (811) formed on the portion of minor diameter of the semicrown (8) and suitably folded over 90° in correspondence of the two ends, and of a semicircular listel (812) able to be fixed to the semicrown (8) on the side opposite to that of the wire (810). Said wire (810) being easily releasable from the semicrown (8), so that the insertion and possible removal or replacement of the removal means (4) result correspondingly facilitated also without intervening on the listel (812). The wire (810) and the listel (812) act also as forward and, respectively, backward travel limits of removal means (4) within the respective seats of the semicrown (8). The seats (81) for removal members (4) are shaped as slits, that is, they are open on both sides of the semicrown (8), in order to act more easily on the respective driving heels both before and after the overturning of same semicrown.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. A method for manufacturing a tubular knitted article with a toe end closed by means of a machine provided with a cylinder with a first series of needles and a second series of needles disposed opposite to each other on corresponding semicylindrical portions of said cylinder and with a plate provided with hooks the method comprising the steps of:

utilizing the needles of said first series of needles and corresponding hooks of the plate for the formation of a fabric portion of the toe shaped as a pocket;

removing the fabric portion engaged by the hooks from a position of formation;

transferring the fabric portion by a rotation of 180° about a diametral axis of said cylinder to dispose the fabric portion in a position adjacent to said second series of needles;

between said step of the removing the fabric portion engaged by the hooks of the plate and said step of transferring, providing an intermediate step of transferring the fabric portion engaged by the hooks of the plate onto a temporary support for the fabric portion, said temporary support being connected to said cylinder.

2. The method according to claim 1, wherein said means used in said intermediate step comprises said first series of needles.

3. The method according to claim 1, wherein said means used in said intermediate step comprises sinkers associated to the cylinder.

4. A method for manufacturing a tubular knitted article with a toe end closed by means of a machine provided with a cylinder with a first series of needles and a second series of needles disposed opposite to each other on corresponding semicylindrical portions of the cylinder and with a plate provided with hooks the method comprising the steps of:

knitting of the article by using the first series of needles and, upon the formation of the first ranks of stitches, operating the removal of the hooks seated in the plate of the machine, so as to cause them to grip the thread together with the first series of needles to engage the corresponding portion of the article's toe with the hooks, and with the plate supporting the hooks;

subsequently to the gripping of the thread, moving back the hooks to go on with the knitting of the article so as to make a fabric pocket portion;

completing the formation of the fabric pocket portion and subsequently cutting any thread used for this purpose;

advancing the hooks so as to move the fabric pocket portion towards the first series of needles;

driving the first series of needles into a lifting movement, for a travel of predetermined length, in order to transfer the fabric pocket portion from the hooks onto the first series of needles;

moving the hooks so that all the fabric will be engaged only to the needles that have formed it; and lifting the plate and hooks to move them away from a textile head of the machine;

positioning a removal device adjacent to the first series of needles, the removal device for picking up the fabric being removed from the hooks, the removal device being in a given position outside the textile head of the machine during the knitting of the fabric pocket portion and being disposed in an operating attitude in the working area of the needles after the removal of the fabric from the hooks of the plate and after the moving away of at least the latter;

hooking up the fabric pocket portion removed from the hooks of the plate with the removal device;

transferring the fabric pocket portion onto the removal device;

transferring the fabric pocket portion removed by a 180° rotation above the needles cylinder about a diametral axis of the needles cylinder, to dispose the fabric pocket portion above the second series of needles;

transferring the fabric pocket portion thus moved onto the second series of needles;

bringing the removal means back to the respective initial position;

bringing the plate group back to its working position; and continuing with the knitting of the article by finishing with the formation of the open end or hem.

5. An apparatus for manufacturing a tubular knitted article starting from the toe of the knitted article, comprising:

a mechanism for knitting a fabric toe shaped as a pocket portion including a cylinder having a first series of needles and a second series of needles positioned opposite to said first series of needles on corresponding semicylindrical portions of said cylinder, with a plate carrying hooks, with a plurality of sinkers associated with said cylinder and with removal and displacement means for the removal of said fabric portion suspended to the hooks and for temporarily supporting said fabric portion hooked up by said hooks of said plate to be overturned, said removal means participating in the formation of said fabric portion and for overturning said fabric portion about a diametral axis of said cylinder, said removal means including support members.

6. The apparatus according to claim 5, wherein said support members are used for the formation of said fabric portion.

7. The apparatus according to claim 5, wherein said support members are connected to said cylinder.

8. The apparatus according to claim 5, further comprising:

a unit driven into motion between an operative position in correspondence with a textile head of the apparatus and an inoperative position outside of the textile head of the apparatus;

an actuation device;

a semicrown mounted rotatably on a support, bidirectionally through 180° about an respective axis under control of said actuation device, wherein said support memebers sre each flat members slidingly housed within radial slits of said semicrown, said support of said semicrown being of an annular shape and being carried by said unit, said flat members having end hook.

9. The apparatus according to claim 8, wherein removal and displacement means operates to overturn said semicrown and includes:

a cam with a spiroidal profile, developed according to a semicircumference external to said semicrown and with a cross-section of a U shape with a concavity turned towards said semicrown, mounted to slide into suitable guide slots formed on a cover of said unit; and an actuator for moving said cam to a first, stand-by position and to a second, operative position;

a gear sector;

a pivot carried by said gear sector and with conical toothing meshing with a pinion fixed to said semicrown, said cam having an inner grooves engaging said pivot in a condition for overturning said semicrown.

10. The apparatus according to claim 9, further comprising:

support blocks mounted on support, said support being annular, said semicrown being connected to said support blocks;

a pivot transversely carried by each block;

a cover having an inner face;

a stationary cam fixed to an inner face of said cover;

a lever swinging about the axis of said pivot and associated with said stationary cam, a lower free end of said lever coming in contact with a corresponding portion of an external edge of said semicrown, in a condition of said semicrown being connected to said support blocks; and an elastic positioner received into each one of blocks, said lever being associated with said elastic positioner, said elastic positioner having an action opposed, as necessary, by said stationary cam.

11. The apparatus according to claim 8, wherein said semicrown has edges defining a minor and major diameters, said semicrown has a wire and a listel on respective edges of said minor and major diameters, for the retention of said support members and for limiting travel of said support members in both directions of motion.

12. The method according to claim 1, wherein said temporary support is one of formation means for the formation of the pocket and structure associated with said formation means.

13. A method for manufacturing a tubular knitted article with a toe end closed by means of a machine provided with a cylinder with a first series of neddles and a second series of needles disposed opposite to each other on corresponding semicylindrical portions of said cylinder and with a plate provided with hooks the method comprising the steps of:

utilizing the needles of said first series of needles and corresponding hooks of the plate for the formation of a fabric portion of the toe shaped as a pocket;

removing the fabric portion engaged by the hooks from a position of formation;

transferring the fabric portion by a rotation of 180° about a diametral axis of said cylinder to dispose the fabric portion in a position adjacent to said second series of needles;

between said step of the removing the fabric portion engaged by the hooks of the plate and said step of transferring, providing an intermediate step of transferring the fabric portion engaged by the hooks of the plate onto a support defined by one or more structural elements used for the formation of a fabric portion, said support being connected to said cylinder.

14. The method according to claim 13, wherein said support comprises said first series of needles.

15. The method according to claim 13, wherein said support comprises sinkers associated with the cylinder.

16. A method for manufacturing a tubular knitted article with a toe end closed by means of a machine provided with a cylinder with a first series of needles and a second series of needles disposed opposite to each other on corresponding semicylindrical portions of said cylinder and with a plate provided with hooks the method comprising the steps of:

utilizing the needles of said first series of needles and corresponding hooks of the plate for the fornation of a fabric portion of the toe shaped as a pocket;

removing the fabric portion engaged by the hooks from a position of formation;

transferring the fabric portion by a rotation of 180° about a diametral axis of said cylinder to dispose the fabric portion in a position adjacent to said second series of needles;

between said step of the removing the fabric portion engaged by the hooks of the plate and said step of transferring, providing an intermediate step of transferring the fabric portion engaged by the hooks of the plate onto temporary support means connected to said cylinder for supporting the fabric portion.

17. The method according to claim 16, wherein said temporary support means used in said intermediate step comprises said first series of needles.

18. The method according to claim 16, wherein said temporary support means used in said intermediate step comprises sinkers associated to the cylinder.

19. The method according to claim 16, wherein said temporary support means used in said intermediate step comprises flat members.

20. The method according to claim 16, wherein said temporary support means used in said intermediate step comprises radially moveable support members.

* * * * *